US007704939B2

(12) United States Patent
Suzuki et al.

(10) Patent No.: US 7,704,939 B2
(45) Date of Patent: Apr. 27, 2010

(54) SURFACTANT

(75) Inventors: Kazumitsu Suzuki, Kyoto (JP); Shunichiro Yamaguchi, Kyoto (JP)

(73) Assignee: Sanyo Chemical Industries, Ltd., Kyoto-shi (JP)

( * ) Notice: Subject to any disclaimer, the term of this patent is extended or adjusted under 35 U.S.C. 154(b) by 201 days.

(21) Appl. No.: 11/626,885

(22) Filed: Jan. 25, 2007

(65) Prior Publication Data

US 2007/0167343 A1 Jul. 19, 2007

Related U.S. Application Data

(63) Continuation-in-part of application No. PCT/JP2005/015748, filed on Aug. 30, 2005.

(30) Foreign Application Priority Data

| | | |
|---|---|---|
| Aug. 31, 2004 | (JP) | 2004-253473 |
| Oct. 19, 2004 | (JP) | 2004-303714 |
| Jul. 14, 2005 | (JP) | 2005-206196 |

(51) Int. Cl.

| | |
|---|---|
| ***C11D 17/08*** | (2006.01) |
| ***C11D 7/32*** | (2006.01) |
| ***C11D 7/34*** | (2006.01) |
| ***C11D 7/36*** | (2006.01) |
| *B08B 6/00* | (2006.01) |

(52) U.S. Cl. ..... 510/436; 510/431; 510/175; 510/177; 510/245; 510/434; 562/8; 134/1.2; 134/1.3

(58) Field of Classification Search ..... 562/8; 510/175, 177, 245, 431, 434, 436; 134/1.2, 134/1.3

See application file for complete search history.

(56) References Cited

U.S. PATENT DOCUMENTS

| | | | | |
|---|---|---|---|---|
| 2,345,388 | A * | 3/1944 | Ericks et al. | 558/152 |
| 2,660,562 | A | 11/1953 | Axe et al. | |
| 2,702,819 | A * | 2/1955 | Whitney et al. | 562/86 |
| 2,832,743 | A * | 4/1958 | Henderson et al. | 510/498 |
| 4,452,692 | A | 6/1984 | Kneissl et al. | |
| 5,124,444 | A | 6/1992 | Van Ness et al. | |
| 5,663,334 | A * | 9/1997 | Sheldrake et al. | 544/122 |
| 7,396,806 | B2 * | 7/2008 | Sakai et al. | 510/175 |
| 2003/0158059 | A1 | 8/2003 | Sakai et al. | |
| 2007/0248554 | A1 * | 10/2007 | Ishii et al. | 424/70.2 |

FOREIGN PATENT DOCUMENTS

| | | |
|---|---|---|
| CN | 1469918 | 1/2004 |
| JP | 5766904 | 4/1982 |
| JP | 57066904 | 4/1982 |
| JP | 57133199 | 8/1982 |
| JP | 57192490 | 11/1982 |
| JP | 6041977 | 3/1985 |
| JP | 60041977 | 3/1985 |
| JP | 3000799 | 1/1991 |
| JP | 03000799 | 1/1991 |
| JP | 05138142 | 6/1993 |
| JP | 06041770 | 2/1994 |
| JP | 6330090 | 11/1994 |
| JP | 06330090 | 11/1994 |
| JP | 940998 | 2/1997 |
| JP | 09040998 | 2/1997 |
| JP | 2005223030 | 8/2005 |
| WO | 0233033 | 4/2002 |
| WO | WO 2005/117815 | * 12/2005 |

OTHER PUBLICATIONS

Asahi Chem Res Lab Ltd., JP 03-000799, 1989, English Translation, pp. 1-7.*

* cited by examiner

*Primary Examiner*—Rosalynd Keys
*Assistant Examiner*—Yate' K Cutliff
(74) *Attorney, Agent, or Firm*—Dennison, Schultz & MacDonald

(57) ABSTRACT

To provide a surfactant which is obtainable by using substantially no alkali metal, has excellent readhesion prevention ability of finely-pulverized particles at the time of cleaning, and is capable of quite efficient and advanced cleaning.

In the present invention, a surfactant which comprises a neutralized salt (AB1) and/or neutralized salt (AB2) is used.

Neutralized salt (AB1):

a neutralized salt (AB1) which comprises an acidic compound (A1) containing at least each one of an acid group (X1) of an acid having the difference of heat of formation in an acid dissociation reaction (Q1) of 3 to 200 kcal/mol and a hydrophobic group (Y) containing 1 to 36 carbon atoms, and a nitrogen-containing basic compound (B) having the difference of heat of formation in a proton addition reaction of 10 to 152 kcal/mol, wherein (X1) is at least one species selected from a sulfonic acid group, and the like.

Neutralized salt (AB2):

a neutralized salt (AB2) which comprises a polymer (A2) having at least one acid group (X2) within the molecule, and the nitrogen-containing basic compound (B) having the difference of heat of formation in a proton addition reaction of 10 to 152 kcal/mol.

22 Claims, No Drawings

SURFACTANT

This application is a continuation-in-part of PCT/JP2005/015748, filed Aug. 30, 2005.

TECHNICAL FIELD

The present invention relates to a surfactant. More particularly, the invention relates a surfactant which is preferably used as a detergent in cleaning processes during manufacturing processes of electronic materials, electronic components, and the like.

BACKGROUND ART

Recently, with advance of fine processing technologies as represented by very-large-scale integrated circuits, trace amounts of impurities which remain on substrates (metal ions, and particles of inorganic materials such as metals and organic materials such as resist resins) have a large influence on performances or yield of devices, therefore the control of impurities has become quite important. In particular, since the particle itself to be cleaned off, becomes more easily adhered on interfaces by further pulverization of particles, establishment of an advanced cleaning technology is now in urgent need.

For this reason, conventionally, for preventing this contamination by particles, a method of reducing adhesion of particles by adding a surfactant to lower the zeta potential on the particle surface has been proposed (Japanese Kokai Publication Hei-05-138142 and Japanese Kokai Publication Hei-06-41770).

However, since the surfactant proposed in Japanese Kokai Publication Hei-05-138142 is a nonionic surfactant, the zeta potential on the particle surface cannot be sufficiently lowered, and the readhesion prevention ability thereof is insufficient. Moreover, the surfactant proposed in Japanese Kokai Publication Hei-06-41770 is an anionic surfactant, and can improve the readhesion prevention effect to some extent by lowering the zeta potential on the particle surface for sure, but is insufficient in view of the performance. Furthermore, an alkali metal such as sodium ion is used as a counter ion of the anionic surfactant, and thus there were serious problems for causing reliability decrease of devices due to latent flaw or damage of yellowing on the substrate surface caused by alkali metals remaining after cleaning and/or due to diffusion of the alkali metals into the substrate inside, being incapable of using due to heavy foaming at the time of using, or the like.

SUMMARY OF THE INVENTION

Accordingly, the present invention has its object to provide a surfactant which is obtainable by using substantially no alkali metal, has excellent ability to prevent readhesion of finely-pulverized particles at the time of cleaning, and is capable of quite efficient and advanced cleaning.

DETAILED DESCRIPTION OF THE INVENTION

The present inventors have made intensive investigations to obtain the above-mentioned surfactant, and as a result, they found that the above subjects can be solved by using a surfactant comprising an acid group-containing acidic compound and/or an acid group-containing polymer, and a specific counter ion forming a salt therewith. Thereby, they accomplished the present invention.

That is, the present invention relates to a surfactant which comprises a neutralized salt (AB1) and/or neutralized salt (AB2); a detergent which contains said surfactant; a detergent which is used in a cleaning process during a manufacturing process of an electronic material and electronic component; a method of manufacturing an electronic component which comprises a cleaning process comprising at least one selected from the group consisting of ultrasonic cleaning, shower cleaning, spray cleaning, brush cleaning, dip cleaning, dip oscillating cleaning, and single wafer processing cleaning using said detergent.

Neutralized Salt (AB1):

a neutralized salt which comprises an acidic compound (A1) containing at least each one of an acid group (X1) of an acid having the difference of heat of formation in an acid dissociation reaction (Q1) of 3 to 200 kcal/mol and a hydrophobic group (Y) containing 1 to 36 carbon atoms, and a nitrogen-containing basic compound (B) having the difference of heat of formation in a proton addition reaction (Q2) of 10 to 152 kcal/mol, wherein (X1) is at least one species selected from the group consisting of a sulfonic acid group, sulfuric acid group, phosphoric acid group, phosphonic acid group, carboxymethyloxy group, carboxyethyloxy group, (di)carboxymethylamino group, (di)carboxyethylamino group, a group represented by the formula (1), and a group represented by the formula (2):

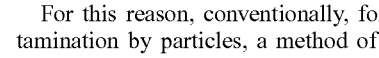

$$—C(H)_a(W)_b—COOH \quad (1)$$

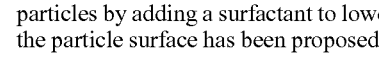

$$—Ar(W)_c—COOH \quad (2)$$

in the formulas, W represents a nitro group, cyano group, trihalomethyl group, formyl group, acetyl group, alkyloxycarbonyl group, alkylsulfonyl group, ammonio group, or a halogen atom; Ar represents an aryl group containing 5 to 14 carbon atoms; a is an integer of 0 or 1, b is an integer of 1 or 2, and c is an integer of 1 to 8; and the carbon number of an alkyl in the alkyloxycarbonyl group and alkylsulfonyl group is 1 to 3.

Neutralized Salt (AB2):

a neutralized salt which comprises a polymer (A2) having at least one acid group (X2) within the molecule, and the nitrogen-containing basic compound (B) having the difference of heat of formation in a proton addition reaction (Q2) of 10 to 152 kcal/mol.

In the following, the present invention is described in detail.

First, the acidic compound (A1) and polymer (A2) constituting the neutralized salts (AB1) and (AB2) are explained.

The acidic compound (A1) contains at least each one of an acid group (X1) of an acid having the difference of heat of formation in an acid dissociation reaction (Q1) of 3 to 200 kcal/mol and a hydrophobic group (Y) containing 1 to 36 carbon atoms, and the polymer (A2) contains at least one acid group (X2) within the molecule. The acid group (X2) preferably has the difference of heat of formation in an acid dissociation reaction (Q1) of 3 to 200 kcal/mol. The term "the difference of heat of formation in an acid dissociation reaction (Q1)" of the acid groups (X1) and (X2) refers to a difference between the heat of formation of HX and that of X in an acid dissociation reaction of the acid (HX) represented by the following formula (6).

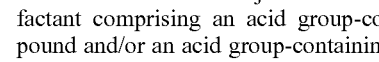

$$HX \rightarrow H^+ + X^- \quad (6)$$

In addition, the difference of heat of formation in an acid dissociation reaction of the acid group (X1) is a value when the hydrophobic group (Y) is assumed as a hydrogen atom.

Moreover, the difference of heat of formation in an acid dissociation reaction of the acid group (X2) is a value when a polymer chain to which the acid group (X2) is bound is assumed as a hydrogen atom.

For example, in the case where the acid group is a sulfonic acid group (—$SO_3H$), this value is calculated for H—$SO_3H$; in the case where it is a sulfuric acid group (–$OSO_3H$), this value is calculated for H—$OSO_3H$; in the case where it is a phosphoric acid group (—$OPO_3H_2$ or —OP(O)(OH)O—), this value is calculated for H—$PO_3H_2$; in the case where it is a phosphonic acid group (—$PO_3H_2$), this value is calculated for H—$OPO_3H_2$; in the case where it is a carboxyl group (—COOH), this value is calculated for H—COOH; in the case where it is a carboxymethyloxy group (—$OCH_2COOH$), this value is calculated for H—$OCH_2COOH$; in the case where it is a carboxyethyloxy group (—$OCH_2CH_2COOH$), this value is calculated for H—$OCH_2CH_2COOH$; in the case where it is a (di)carboxymethylamino group (—$NRCH_2COOH$ or —$N(CH_2COOH)_2$), this value is calculated for H—$NHCH_2COOH$; in the case where it is a (di) carboxyethylamino group (—$NRCH_2CH_2COOH$ or —$N(CH_2CH_2COOH)_2$), this value is calculated for H—$NHCH_2CH_2COOH$; in the case where it is the group represented by the formula (1), this value is calculated for the compound represented by the formula (3); in the case where it is the group represented by the formula (2), this value is calculated for the compound represented by the formula (4). In addition, R represents a hydrogen atom or an alkyl group containing 1 to 24 carbon atoms (methyl, ethyl, propyl, butyl, octyl, nonyl, decyl, dodecyl group, etc.).

$$H—C(H)_a(W)_b—COOH \quad (3)$$

$$H—Ar(W)_c—COOH \quad (4)$$

:in the formulas, W represents a nitro, cyano, trihalomethyl, formyl, acetyl, alkyloxycarbonyl, alkylsulfonyl or ammonio group, or a halogen atom; Ar represents an aryl group containing 5 to 14 carbon atoms; a is an integer of 0 or 1, b is an integer of 1 or 2, and c is an integer of 1 to 8; and the carbon number of an alkyl in the alkyloxycarbonyl group and alkylsulfonyl group is 1 to 3. As the alkyl in the alkyloxycarbonyl group and alkylsulfonyl group, there may be mentioned methyl, ethyl or propyl.

That is, the difference of heat of formation (Q1) is represented by the following formula (8);

$$Q1=\Delta_f H^o_{HX}-\Delta_f H^o_{X—} \quad (8)$$

[in the formula, $\Delta_f H^o_{HX}$ and $\Delta_f H^o_{X—}$ represent the differences of heat of formation of HX and X— in vacuum, respectively].

Herein, the value of the heat of formation ($\Delta_f H^o$) can be calculated using the semiempirical molecular orbital method (MOPAC PM3 method) described in J. Chem. Soc. Perkin Trans. 2, p. 923 (1995).

The heat of formation can be calculated, for example, using "CAChe Worksystem 6.01" manufactured by FUJITSU, LTD. as the heat of formation in vacuum (25° C.). That is, the heat of formation can be calculated by drawing the molecular structure on "Work Space" to be calculated, optimizing the structure with "MM2 geometry" which is a molecular force field method, and then calculating by "PM3 geometry" which is a semiempirical molecular orbital method.

Moreover, the difference of heat of formation (kcal/mol, 25° C.) in the acid dissociation reaction (Q1) of the acid group (X1) or (X2) is preferably 3 to 200, and in view of lowering the zeta potential and the like, it is more preferably 10 to 150, still more preferably 15 to 100, further preferably 20 to 80, particularly preferably 22 to 75, and most preferably 25 to 70.

As the acid group (X2), there may be mentioned a sulfonic acid group (—$SO_3H$) (Q1=32 kcal/mol), sulfuric acid group (—$OSO_3H$) (Q1=46 kcal/mol), phosphoric acid group (—$PO_3H_2$ or —OP(O) (OH)O—) (Q1=19 kcal/mol), phosphonic acid group (—$PO_3H_2$) (Q1=4.5 kcal/mol), carboxyl group (—COOH) (Q1=21 kcal/mol), and the like.

As examples of the carboxyl group, besides a carboxyl group (—COOH), a carboxymethyloxy group (—$OCH_2COOH$) (Q1=19 kcal/mol), carboxyethyloxy group (—$OCH_2CH_2COOH$) (Q1=20 kcal/mol), (di)carboxymethylamino group (—$NRCH_2COOH$ or —$N(CH_2COOH)_2$) (Q1=26 kcal/mol), (di)carboxyethylamino group (—$NRCH_2CH_2COOH$ or —$N(CH_2CH_2COOH)_2$) (Q1=20 kcal/mol), a group represented by the formula (1) {for example, 1-fluoro-carboxymethyl group (Q1=26 kcal/mol), 1-chloro-carboxymethyl group (Q1=26 kcal/mol), 1,1'-dichlorocarboxymethyl group (Q1=32 kcal/mol), 1-cyano-carboxymethyl group (Q1=32 kcal/mol), etc.}, a group represented by the formula (2) {for example, 3-fluoro-4-carboxyphenyl group (Q1=25 kcal/mol), 3-cyano-4-carboxyphenyl group (Q1=30 kcal/mol), etc.}, and the like are included.

Among these acid groups, in view of the particle readhesion prevention ability, industrial producibility, and the like, a sulfonic acid group, sulfuric acid group, phosphoric acid group, phosphonic acid group and carboxyl group are preferred. When the below-mentioned alkali component (C) is contained, in view of preventing hydrolysis of the neutralized salt (AB2) and the like, more preferred is a sulfonic acid group and carboxyl group, and particularly preferred is a sulfonic acid group.

As the acid group (X1), among the acid groups (X2) exemplified in the above, there may be mentioned a sulfonic acid group, a sulfuric acid group, phosphoric acid group, phosphonic acid group, carboxymethyloxy group, carboxyethyloxy group, (di) carboxymethylamino group, (di) carboxyethylamino group, the group represented by the formula (1), the group represented by the formula (2).

Among these acid groups, in view of the particle readhesion prevention ability, industrial producibility, and the like, a sulfonic acid group, sulfuric acid group, phosphoric acid group, carboxymethyloxy group, and carboxyethyloxy group are preferred. When the below-mentioned alkali component (C) is contained, in view of preventing hydrolysis of the neutralized salt (AB1) and the like, more preferred is a sulfonic acid group, carboxymethyloxy group and carboxyethyloxy group, and particularly preferred is a sulfonic acid group.

As examples of the hydrophobic group (Y) in the acidic compound (A1), an aliphatic hydrocarbon group, alicyclic hydrocarbon group, aromatic ring-containing hydrocarbon group, and the like are included.

As examples of the aliphatic hydrocarbon group, an alkyl group containing 1 to 36 carbon atoms, alkenyl group containing 2 to 36 carbon atoms, and the like are included (both straight chain and branched chain ones).

As the alkyl group, there may be mentioned methyl, ethyl, n- or i-propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, triacontyl, hentriacontyl, dotriacontyl, tritriacontyl, tetratriacontyl, pentatriacontyl, hexatriacontyl, and the like groups.

As the alkenyl group, there may be mentioned n- or i-propenyl, hexenyl, heptenyl, octenyl, decenyl, undecenyl, dodecenyl, tetradecenyl, pentadecenyl, hexadecenyl, heptadecenyl, octadecenyl, nonadecenyl, 2-ethyldecenyl, eicosenyl, heneicosenyl, docosenyl, tricosenyl, tetracosenyl, pentacosenyl, hexacosenyl, heptacosenyl, octacosenyl, nonacosenyl, and the like groups.

As examples of the alicyclic hydrocarbon group, cycloalkyl groups containing 3 to 36 carbon atoms, etc. are included, and there may be mentioned cyclopropyl, cyclobutyl, cyclopentyl, cyclohexyl, cycloheptyl, cyclooctyl, cyclononyl, cyclodecyl, cyclododecyl, cyclohexadecyl, cycloeicosyl, cyclohexacosyl, cyclononacosyl, cyclotetratriacontyl, cyclopentatriacontyl, cyclohexatriacontyl, and the like groups.

As examples of the aromatic ring-containing hydrocarbon group, aromatic hydrocarbons containing 7 to 36 carbon atoms, etc. are included, and there may be mentioned methylphenyl, ethylphenyl, n- or i-propylphenyl, butylphenyl, pentylphenyl, hexylphenyl, heptylphenyl, octylphenyl, nonylphenyl, decylphenyl, undecylphenyl, dodecylphenyl, eicosylphenyl, dimethylphenyl, methylnaphthyl, ethylnaphthyl, n- or i-propylnaphthyl, butylnaphthyl, pentylnaphthyl, hexylnaphthyl, heptylnaphthyl, octylnaphthyl, nonylnaphthyl, decylnaphthyl, undecylnaphthyl, dodecylnaphthyl, eicosylnaphthyl, and the like groups.

Among the hydrophobic groups (Y), aliphatic hydrocarbon groups and aromatic ring-containing hydrocarbon groups are preferred, and more preferred are octyl, nonyl, decyl, undecyl, dodecyl, tridecyl, tetradecyl, pentadecyl, hexadecyl, heptadecyl, octadecyl, octylphenyl, nonylphenyl, dodecylphenyl, octylnaphthyl, nonylnaphthyl and dodecylnaphthyl groups, and particularly preferred are octyl, nonyl, dodecyl, hexadecyl, octadecyl, octylphenyl, dodecylphenyl and octylnaphthyl groups.

The carbon atom number of the hydrophobic groups (Y) is 1 to 36, more preferably 4 to 24, particularly preferably 8 to 24. In these hydrophobic groups, apart or all of hydrogen atoms may be substituted by another atom (fluorine atom, chlorine atom, bromine atom, iodine atom, etc.) or a functional group (hydroxyl group, amino group, mercapto group, perfluoro alkyl group, carboxyl group, organic group having an ether bond, amide bond, or ester bond, etc.), and this functional group may contain one or more oxyalkylene groups.

Examples of the acidic compound (A1) include the following compounds.

Sulfonic Acid Group-Containing Compounds (A1-1)

Alkylsulfonic acids (octylsulfonic acid, decylsulfonic acid, dodecylsulfonic acid, myristylsulfonic acid, cetylsulfonic acid, stearylsulfonic acid, etc.), benzenesulfonic acids, alkylbenzenesulfonic acids (toluenesulfonic acid, xylenesulfonic acid, dodecylbenzenesulfonic acid, eicosylbenzenesulfonic acid, etc.), naphthalenesulfonic acids, alkylnaphthalenesulfonic acids (methylnaphthalenesulfonic acid, dodecylnaphthalenesulfonic acid, eicosylnaphthalenesulfonic acid, etc.), polyoxyalkylene alkyl ether sulfonic acids (polyoxyethylene octylether sulfonic acid, polyoxyethylene laurylether sulfonic acid, etc.), polyoxyalkylene alkylarylether sulfonic acids (polyoxyethylene octylphenylether sulfonic acid, polyoxyethylene laurylphenylether sulfonic acid, etc.), sulfosuccinates, (di)octyl sulfosuccinate, (di)lauryl sulfosuccinate, (di)octyl polyoxyethylene sulfosuccinate, (di)lauryl polyoxyethylene sulfosuccinate, (di)amyl sulfosuccinate, (di)-2-ethylhexyl sulfosuccinate etc.), α-olefin sulfonic acids (a sulfonation product of 1-octene, sulfonation product of 1-nonene, sulfonation product of 1-decene, sulfonation product of 1-dodecene, sulfonation product of 1-tetradecene, sulfonation product of 1-pentadecene, sulfonation product of 1-hexadecene, sulfonation product of 1-octadecene, etc.), alkyldiphenyl ether sulfonic acids (methyldiphenyl ether (di)sulfonic acid, dodecyldiphenyl ether (di)sulfonic acid, etc.), alkyloyl aminoethyl sulfonic acids (octyloyl-N-methylaminoethyl sulfonic acid, lauryloyl-N-methylaminoethyl sulfonic acid), fatty acid ethyl ester sulfonic acids (sulfoethyl octylate, sulfoethyl laurate, etc.), and the like.

Sulfuric Acid Group-Containing Compounds (A1-2)

Alkylsulfates (octylsulfate, decylsulfate, dodecylsulfate, myristylsulfate, cetylsulfate, stearylsulfate, etc.), polyoxyalkylene alkyl ether sulfates (polyoxyethylene octyl ether sulfate, polyoxyethylene lauryl ether sulfate, etc.), polyoxyalkylene alkylaryl ether sulfates (polyoxyethylene octylphenyl ether sulfate, polyoxyethylene nonylphenyl ether sulfate, etc.), acylamide alkylsulfates (octyloylamide ethylsulfate, lauryloylamide ethylsulfate, etc.), acylamide polyoxyalkylene sulfates (octyloylamide polyoxyethylene sulfate, lauryloylamide polyoxyethylene sulfate, etc.), and the like.

Phosphoric Acid Group-Containing Compounds (A1-3)

(di)alkylphosphates ((di)octylphosphate, (di)decylphosphate, (di)dodecylphosphate, (di)myristylphosphate, (di)cetylphosphate, (di)stearylphosphate, etc.), (di)polyoxyalkylene alkyl ether phosphates ((di)polyoxyethylene octyl ether phosphate, (di)polyoxyethylene lauryl ether phosphate, etc.), polyoxyalkylene alkylaryl ether phosphates (polyoxyethylene octylphenyl ether phosphate, polyoxyethylene nonylphenyl ether phosphate, etc.), and the like.

Phosphonic Acid Group-Containing Compounds (A1-4)

Alkylphosphonic acids (octylphosphonic acid, decylphosphonic acid, dodecylphosphonic acid, myristylphosphonic acid, cetylphosphonic acid, stearylphosphonic acid, etc.), alkylbenzenephosphonic acids (toluene phosphonic acid, xylene phosphonic acid, dodecylbenzenephosphonic acid, eicosylbenzenephosphonic acid, etc.), alkylnaphthalene phosphonic acids (methylnaphthalene phosphonic acid, dodecylnaphthalene phosphonic acid, eicosylnaphthalene phosphonic acid, etc.), polyoxyalkylene alkyl ether phosphonic acids (polyoxyethylene octyl ether phosphonic acid, polyoxyethylene laurylether phosphonic acid, etc.), polyoxyalkylene alkylaryl ether phosphonic acid (polyoxyethylene octylphenyl ether phosphonic acid, polyoxyethylene laurylphenyl ether phosphonic acid, etc.), alkyldiphenyl ether phosphonic acids (methyldiphenyl ether (di)phosphonic acid, dodecyldiphenyl ether (di)phosphonic acid, etc.), and the like.

Carboxymethyloxy Group-Containing Compounds (A1-5)

Carboxymethylation products of higher alcohols (octylcarboxymethyl ether, laurylcarboxymethyl ether, etc.), carboxymethylation products of polyoxyalkylene alkyl ethers (carboxymethylation products of polyoxyethylene octyl ether, carboxymethylation products of polyoxyethylene nonyl ether, carboxymethylation products of polyoxyethylene decyl ether, carboxymethylation products of polyoxyethylene dodecyl ether, carboxymethylation products of polyoxyethylene myristyl ether, carboxymethylation products of polyoxyethylene stearyl ether, carboxymethylation products of polyoxyethylene oleyl ether, etc.), and the like.

Carboxyethyloxy Group-Containing Compounds (A1-6)

Carboxyethylation products of higher alcohols (octylcarboxyethyl ether, laurylcarboxyethyl ether, etc.), carboxyethylation products of polyoxyalkylene alkyl ethers (carboxyethylation products of polyoxyethylene octyl ether, carboxyethylation products of polyoxyethylene nonyl ether, carboxyethylation products of polyoxyethylene decyl ether, carboxyethylation products of polyoxyethylene dodecyl ether, carboxyethylation products of polyoxyethylene myristyl ether, carboxyethylation products of polyoxyethylene stearyl ether, carboxyethylation products of polyoxyethylene oleyl ether, etc.), and the like.

(Di)Carboxymethylamino Group-Containing Compounds (A1-7)

Alkylamino(di)acetic acids (octylamino(di)acetic acid, laurylamino(di)acetic acid, etc.), Alkyloylamino(di) acetic acid (lauroyl-N-methylamino (di)acetic acid, etc.), and the like.

(Di)Carboxyethylamino Group-Containing Compounds (A1-8)

Alkylamino(di)propionic acids (octylamino(di)propionic acid, laurylamino(di)propionic acid, etc.), Alkyloylamino(di)propionic acid (lauroyl-N-methylamino (di)propionic acid, etc.), and the like.

Compounds Containing the Group Represented by the Formula (1) (A1-9)

2-Fluorooctanoic acid, 2-chlorooctanoic acid, 2,2-dichlorooctanoic acid, 2-fluorolauric acid, 2-chlorolauric acid, 2,2-dichlorolauric acid, 2-cyanooctanoic acid, 2-cyanolauric acid, and the like.

Compounds Containing the Group Represented by the Formula (2) (A1-10)

4-Octyl-2-fluorobenzoic acid, 4-dodecyl-2-fluorobenzoic acid, 4-octyl-2-cyanobenzoic acid, 4-dodecyl-2-cyanobenzoic acid, 2-octyl-4-fluorobenzoic acid, and the like.

Among these, preferred are alkylsulfonic acids, alkylbenzenesulfonic acids, alkylnaphthalenesulfonic acids, sulfosuccinic acids, polyoxyalkylene alkyl ether sulfonic acids, polyoxyalkylene alkylaryl ether sulfonic acids, α-olefin sulfonic acids, alkyloylaminoethylsulfonic acids, alkylsulfates, polyoxyalkylene alkyl ether sulfates, polyoxyalkylene alkylaryl ether sulfates, acylamide alkylsulfates, (di)alkylphosphates, (di)polyoxyalkylenealkyl ether phosphates, polyoxyalkylene alkylaryl ether phosphates, alkyl phosphonic acids and carboxymethylation products of polyoxyalkylenealkylethers. More preferred are alkylsulfonic acids, alkylbenzenesulfonic acids, alkylnaphthalene sulfonic acids, sulfosuccinic acids, polyoxyalkylene alkyl ether sulfonic acids, polyoxyalkylene alkylaryl ether sulfonic acids, α-olefin sulfonic acids, alkyloylaminoethylsulfonic acids, alkylsulfates, polyoxyalkylene alkyl ether sulfates, polyoxyalkylene alkylaryl ether sulfates, acylamide alkylsulfates, and carboxymethylation products of polyoxyalkylene alkyl ethers. Particularly preferred are alkylsulfonic acids, alkylbenzenesulfonic acids, alkylnaphthalene sulfonic acids, sulfosuccinic acids, polyoxyalkylene alkyl ether sulfonic acids, polyoxyalkylene alkylaryl ether sulfonic acids, α-olefin sulfonic acids, and alkyloylaminoethylsulfonic acids.

The acidic compounds (A1) may be used alone or two or more of them may be used as a mixture.

An HLB value of the acidic compound (A1) is preferably 5 to 30, more preferably 7 to 17, still more preferably 9 to 16, particularly preferably 10 to 15, most preferably 10.5 to 14.5.

In addition, in the practice of the present invention, the HLB value is a value calculated by Oda method using the formula (18). ("New Introduction to Surface Active Agents" written by Takehiko Fujimoto (Sanyo Chemical Industries, Ltd.), p 197)

$$HLB = 10 \times (\text{inorganic nature/organic nature}) \quad (18)$$

The organic nature and inorganic nature in the formula is a total of numerical values defined per atom and functional group constituting a molecule, and the values described in the above document can be used.

The pKa of the acidic compound (A1) is preferably not more than 8.0, and in view of lowering the zeta potential and the like, it is more preferably not more than 7.0, particularly preferably not more than 5.5, most preferably not more than 3.0. Additionally, it is preferably not less than 0.5. Herein, the "pKa" refers to the acid dissociation constant of the first step. The pKa can be determined by well-known methods {for example, J. Am. Chem. Soc., 1673 (1967)}, and the like.

As the polymer (A2) containing at least one acid group (X2), in view of the particle readhesion prevention ability and the like, preferred are a sulfonic acid group-containing polymer (A2-1), a sulfuric acid group-containing polymer (A2-2), a phosphoric acid group-containing polymer (A2-3), a phosphonic acid group-containing polymer (A2-4) and a carboxyl group-containing polymer (A2-5). More preferred are the sulfonic acid group-containing polymer (A2-1) and the carboxyl group-containing polymer (A2-5), particularly preferred is the sulfonic acid group-containing polymer (A2-1).

As the sulfonic acid group-containing polymer (A2-1), there may be mentioned polymers obtainable by radical polymerization using a sulfonic acid group-containing unsaturated monomer (aX-1) (A2-1-1), polymers obtainable by introducing a sulfonic acid group by a polymer reaction (A2-1-2), polymers obtainable by a polycondensation reaction with formaldehyde using an aromatic compound containing a sulfonic acid group within the molecule (aY-1) (A2-1-3), and the like.

As the sulfuric acid group-containing polymer (A2-2), there may be mentioned polymers obtainable by radical polymerization using a sulfuric acid group-containing unsaturated monomer (aX-2) (A2-1-2), polymers obtainable by introducing a sulfuric acid group by a polymer reaction (A2-2-2), and the like.

As the phosphoric acid group-containing polymers (A2-3), there may be mentioned polymers obtainable by radical polymerization using a phosphoric acid group-containing unsaturated monomer (aX-3) (A2-3-1), polymers obtainable by introducing a phosphoric acid group by a polymer reaction (A2-3-2), and the like.

As the phosphonic acid group-containing polymer (A2-4), there may be mentioned polymers obtainable by radical polymerization using a phosphonic acid group-containing unsaturated monomer (aX-4) (A2-4-1), polymers obtainable by introducing a phosphonic acid group by a polymer reaction (A2-4-2), polymers obtainable by a polycondensation reaction with formaldehyde using an aromatic compound containing a phosphonic acid group within the molecule (aY-4) (A2-4-3), and the like.

As the carboxyl group-containing polymer (A2-5), there may be mentioned polymers obtainable by radical polymerization using a carboxyl group-containing unsaturated monomer (aX-5) (A2-5-1), polymers obtainable by introducing a carboxyl group by a polymer reaction (A2-5-2), polymers obtainable by a polycondensation reaction with formaldehyde using an aromatic compound containing a carboxyl group within the molecule (aY-5) (A2-5-3), and the like.

Among the polymers (A2), in view of the particle readhesion prevention ability and the like, the sulfonic acid group-containing polymers (A2-1) are preferred, more preferred are (A2-1-1), (A2-1-2) and (A2-1-3), particularly preferred are (A2-1-2) and (A2-1-3).

The polymers (A2) to be used in the present invention may be used alone or two or more of them may be used as a mixture.

As the sulfonic acid group-containing unsaturated monomer (aX-1), there may be mentioned aliphatic unsaturated sulfonic acids containing 2 to 20 carbon atoms (vinylsulfonic acid, (meth)allylsulfonic acid, etc.), aromatic unsaturated sulfonic acids containing 6 to 24 carbon atoms (styrenesulfonic acid, p-nonylstyrenesulfonic acid, etc.), sulfonic acid group-containing (meth)acrylates {2-(meth)acryloyloxyethanesulfonic acid, 2-(meth)acryloyloxypropanesulfonic acid, 3-(meth)acryloyloxypropanesulfonic acid, 2-(meth)acryloyloxybutanesulfonic acid, 4-(meth)acryloyloxybutanesulfonic acid, 2-(meth)acryloyloxy-2,2-dimethylethanesulfonic acid, p-(meth)acryloyloxymethylbenzenesulfonic acid, etc.}, sulfonic acid group-containing (meth)acrylamides {2-(meth) acryloylaminoethanesulfonic acid, 2-(meth)acryloylaminopropanesulfonic acid, 3-(meth) acryloylaminopropanesulfonic acid, 2-(meth) acryloylaminobutanesulfonic acid {for example, 2-acryloylamino-2,2'-dimethylethanesulfonic acid}, 4-(meth)acryloylaminobutanesulfonic acid, 2-(meth)acryloylamino-2,2-dimethylethanesulfonic acid, p-(meth)acryloylamino methylbenzenesulfonic acid, etc.}, alkyl (carbon atoms 1 to 20) (meth)allylsulfosuccinates {methyl(meth)allylsulfosuccinate, lauryl(meth)allylsulfosuccinate, eicosyl (meth)allylsulfosuccinate, etc.}, and the like.

Among these, in view of polyemrizability, hydrolysis resistivity in water, and the like, preferred are aliphatic unsaturated sulfonic acids containing 2 to 20 carbon atoms, aromatic unsaturated sulfonic acids containing 6 to 24 carbon atoms and sulfonic acid group-containing (meth)acrylamides, more preferred are vinylsulfonic acid, styrenesulfonic acid, and 2-(meth)acryloylamino-2,2-dimethylethanesulfonic acid.

As the sulfuric acid group-containing unsaturated monomer (aX-2), there may be mentioned sulfates of the hydroxyl group-containing monomers (aZ2) mentioned below, and the like.

Among these, in view of polymerizability etc., sulfates of hydroxyl group-containing (meth)acrylates (aZ2-1) are preferred, more preferred are sulfates of 2-hydroxyethyl (meth) acrylate or 2-hydroxypropyl(meth)acrylate.

As the phosphoric acid group-containing unsaturated monomer (aX-3), there may be mentioned phosphates of the hydroxyl group-containing monomers (aZ2) mentioned below, and the like.

Among these, in view of polyemrizability and the like, phosphates of hydroxyl group-containing (meth)acrylates (aZ2-1) are preferred, more preferred are phosphates of 2-hydroxyethyl(meth)acrylate or 2-hydroxypropyl (meth)acrylate.

As the phosphonic acid group-containing unsaturated monomer (aX-4), there may be mentioned (meth)acryloyloxyalkyl(carbon atoms 1 to 20)phosphate {(meth)acryloyloxymethylphosphate, (meth)acryloyloxyethylphosphate, (meth)acryloyloxylaurylphosphate, (meth)acryloyloxyeicosylphosphate, etc.}, and the like.

Among these, in view of polyemrizability and the like, (meth)acryloyloxyethylphosphate is preferred.

As the carboxyl group-containing unsaturated monomer (aX-5), there may be mentioned unsaturated monocarboxylic acids {(meth)acrylic acid, vinylbenzoic acid, allyl acetate, (iso)crotonic acid, cinnamic acid, 2-carboxyethyl acrylate, etc.}, unsaturated dicarboxylic acids and anhydrides thereof {maleic acid (anhydride), fumaric acid, itaconic acid (anhydride), citraconic acid (anhydride), mesaconic acid, etc.}, monoalkyl(alkyl carbon atoms 1 to 20) esters of unsaturated dicarboxylic acids {monomethyl maleate, monoethyl maleate, monolauryl maleate, monoeicosyl maleate, monomethyl fumarate, monoethyl fumarate, monolauryl fumarate, monoeicosyl fumarate, monomethyl itaconate, monoethyl itaconate, monolauryl itaconate, monoeicosyl itaconate, etc.}, and the like.

Among these, in view of polyemrizability, hydrolysis resistivity in water, and the like, preferred are unsaturated monocarboxyic acids, unsaturated dicarboxylic acids, and anhydrides of those, more preferred are (meth)acrylic acid, maleic acid (anhydride), fumaric acid, and itaconic acid (anhydride).

The polymers obtainable by radical polymerization using an unsaturated monomer (A2-1-1) to (A2-5-1) can be copolymerized with other radically polymerizable unsaturated monomers (aZ) than the sulfonic acid group-containing unsaturated monomer (aX-1), sulfuric acid group-containing unsaturated monomer (aX-2), phosphoric acid group-containing unsaturated monomer (aX-3), phosphonic acid group-containing unsaturated monomer (aX-4) and carboxyl group-containing unsaturated monomer (aX-5).

As the other radically polymerizable unsaturated monomers (aZ), there may be mentioned the following, and the like.

(aZ1); straight chain- or branched alkyl(meth)acrylates containing 1 to 36 carbon atoms [methyl(meth)acrylate, ethyl (meth)acrylate, propyl(meth)acrylate, butyl(meth)acrylate, pentyl(meth)acrylate, hexyl(meth)acrylate, octyl (meth) acrylate, decyl(meth)acrylate, dodecyl(meth)acrylate, 2-methylundecyl(meth)acrylate, tetradecyl(meth)acrylate, octadecyl(meth)acrylate, n-eicosyl(meth)acrylate, tetracosyl (meth)acrylate, 2-methyl-nonadecyl(meth)acrylate, 2-nonyltetracosyl(meth)acrylate, and the like].

(aZ2); hydroxyl group-containing monomers (aZ2-1); hydroxyl group-containing (meth)acrylates (aZ2-1-1); (meth)acrylates represented by the general formula (13);

$$CH_2{=}C(R^6)\text{—}COO\text{-}(AO)_x\text{—}H \quad (13)$$

in the formula, $R^6$ represents a hydrogen atom or methyl group, AO represents an oxyalkylene group containing 2 to 4 carbon atoms, and x represents an integer of 1 to 20 (preferably 1).

As (aZ2-1-1), there may be mentioned hydroxyalkyl (carbon atoms 2 to 4) (meth)acrylates such as 2-hydroxyethylmethacrylate, 2-hydroxyethyl acrylate, 2-hydroxypropyl methacrylate, 2-hydroxypropyl acrylate, 3-hydroxypropyl (meth)acrylate and 2-hydroxyethoxyethyl(meth)acrylate.

(aZ2-1-2); (meth)acrylates of polyhydric alcohols containing 3 to 8 hydroxyl groups; (meth)acrylates of the polyhydric alcohols (E) mentioned below [for example, glycerin mono- or di-(meth)acrylate, trimethylolpropane mono- or di-(meth) acrylate, sucrose (meth)acrylate, etc.], (aZ2-2); alkenols containing 2 to 12 carbon atoms [vinyl alcohols (formed by hydrolysis of vinyl acetate unit), alkenols containing 3 to 12 carbon atoms {(meth)allyl alcohol, (iso)propenyl alcohol, crotyl alcohol, 1-butene-3-ol, 1-butene-4-ol, 1-octenol, 1-undecenol, 1-dodecenol, etc.}, and the like], (aZ2-3); alkene diols containing 4 to 12 carbon atoms [2-butene-1,4-diol, etc.], (aZ2-4); hydroxyl group-containing alkenyl ethers having an alkenyl group containing 3 to 12 carbon atoms [hydroxyalkyl (carbon atoms 1 to 6) alkenyl (carbon atoms 3 to 12) ethers {e.g. 2-hydroxyethylpropenyl ether, etc.}, alkenyl (carbon atoms 3 to 12) ethers of the polyhydric alcohols (E) {e.g. trimethylolpropane mono- and di-(meth)allyl ether, sucrose (meth)allyl ether, etc.}, and the like], (aZ2-5); hydroxyl group-containing aromatic monomers [o-, m-, or p-hydroxystyrene, etc.], (aZ2-6); (poly)oxyalkylene ethers of monomers (aZ2-1) to (aZ2-5) [for example, a monomer in which at least one hydroxyl group of (aZ2-1) to (aZ2-5) is substituted by —O-$(AO)_y$-AO—H {however, AO is the same as in the general formula (13), y is an integer of 0, or 1 to 20}, and the like].

(aZ3); amide group-containing monomers, (aZ3-1); (meth)acrylamides represented by the following general formula (14)

$$CH_2{=}C(R^6)—CO—N(R')—R'' \quad (14)$$

In the formula, $R^6$ is the same as in the general formula (13), R' and R" each independently represents a hydrogen atom or a group selected from alkyl group containing 1 to 4 carbon atoms and hydroxyalkyl group containing 1 to 4 carbon atoms.

As (aZ3-1), there may be mentioned unsubstituted or alkyl-substituted acrylamides [acrylamide, methacrylamide, N-mono-alkyl (carbon atoms 1 to 4) or N,N-dialkyl(carbon atoms 1 to 4)-(meth)acrylamides {(meth)acrylamides in which a hydrogen atom of the amino group is substituted by (di)methyl, (di)ethyl, (di)i-propyl, $(di)_n$-butyl or (di)i-butyl, etc.}, etc.], hydroxyalkyl-substituted acrylamides [(meth) acrylamide in which a hydrogen atom of the amino group is substituted by N-mono-hydroxyalkyl (carbon atoms 1 to 4) or N,N-di hydroxyalkyl (carbon atoms 1 to 4) {(meth)acrylamide in which a hydrogen atom of the amino group is substituted by N-hydroxymethyl, N,N-dihydroxymethyl, N,N-di-2-hydroxyethyl, or N,N-di-4-hydroxybutyl, etc.}, etc.], and the like.

(aZ3-2); N-vinylcarboxylic acid amides [N-vinylcarboxylic acid amides {N-vinyl formamide, N-vinyl acetoamide, N-vinyl n- or i-propionamide, N-vinylhydroxy acetoamide, etc.}, N-vinyl lactam {N-vinyl pyrrolidone, etc.} and the like].

(aZ4); Nitrogen atom-containing unsaturated monomers other than (aZ3), (aZ4-1); amino group-containing monomers containing at least one primary, secondary or tertiary amino group, (aZ4-1-1); amino group-containing aliphatic monomers, (aZ4-1-1-1); mono- and di-alkenyl amines represented by the general formula D-$NHD^1$ (however, in the formula, $D^1$ represents a hydrogen atom or D, and D represents analkenyl group containing 2 to 10 carbon atoms, preferably 3 to 6 carbon atoms) [for example, [(di)(meth)allylamine, (iso)crotylamine, etc.], (aZ4-1-1-2); amino group-containing acrylic monomers [amino group-containing (meth)acrylates [mono-alkyl (carbon atoms 1 to 4) aminoalkyl (carbon atoms 2 to 6) (meth) acrylates {(meth)acrylate of aminoethyl, aminopropyl, methyl aminoethyl, ethyl aminoethyl, butyl aminoethyl or methyl aminopropyl}, dialkyl (carbon atoms 1 to 4) aminoalkyl (carbon atoms 2 to 6) (meth)acrylates {dimethylaminoethyl(meth)acrylate, diethylaminoethyl(meth)acrylate, dibutylaminoethyl (meth)acrylate, etc.}, etc.], and amino group-containing (meth)acrylamides relevant to these (meth) acrylates, etc.], (aZ4-1-2); amino group-containing heterocyclic monomers [amino group-containing heterocyclic acrylic monomers [morpholino-alkyl (carbon atoms 2 to 4) (meth)acrylates {morpholinoethyl(meth)acrylate, etc.} etc.], vinyl-substituted heterocyclic amines [vinyl pyridines {4- or 2-vinyl pyridine, etc.}, etc.], N-vinyl pyrrole, N-vinyl pyrrolidine, etc.].

(aZ4-1-3); amino group-containing aromatic monomers [aminostyrenes {aminostyrene, (di)methyl aminostyrene, etc.}, etc.], (aZ4-1-4); salts of (aZ4-1-1) to (aZ4-1-3) [hydrochloride, sulfate, phosphate, nitrate or carboxylate containing 1 to 8 carbon atoms].

(aZ4-2); Quaternary ammonium base-containing monomers [quaternary ammonium salts obtainable by quaternarizing (aZ4-1-1) to (aZ4-1-3)].

As a quaternarizing agent, usable are alkyl (carbon atoms 1 to 8) halogenated products (methyl chloride, etc.), benzyl halides (benzyl chloride, etc.), dialkyl (carbon atoms 1 to 2) sulfates (dimethyl sulfate, diethyl sulfate, etc.), dialkyl (carbon atoms 1 to 2) carbonates (dimethyl carbonate, etc.), and the like.

Moreover, as (aZ4-2), a quaternary ammonium salt obtainable by quaternarizing (aZ4-1-4) with one or two or more species of alkylene ((carbon atoms 2 to 4) oxides (ethylene oxide, propylene oxide, etc.) is included.

(aZ4-3); Monomers containing nitrile (cyano group) or nitro group [(meth)acrylonitrile, nitrostyrene, etc.].

(aZ5); Unsaturated hydrocarbon containing 2 to 36 carbon atoms, (aZ5-1); unsaturated aliphatic hydrocarbons containing 2 to 36 carbon atoms [alkenes containing 2 to 36 carbon atoms {ethylene, propylene, isobutene, butene, pentene, heptene, diisobutylene, octene, dodecene, octadecene, etc.}, alkadienes containing 4 to 12 carbon atoms {butadiene, isoprene, 1,4-pentadiene, 1,6-heptadiene, 1,7-octadiene, etc.}, and the like], (aZ5-2); unsaturated alicyclic hydrocarbons containing 5 to 24 carbon atoms [cycloalkenes (cyclohexene, etc.), dicycloalkadienes (cyclopentadiene, dicyclopentadiene, etc.), cyclic terpenes (pinene, limonene, etc.), vinyl (di)cycloalkenes (vinylcyclohexene, etc.), ethylidene (di)cycloalkenes (ethylidene bicycloheptene, ethylidene norbornene, etc.), aromatic ring-containing cycloalkenes (indene, etc.), and the like], (aZ5-3); unsaturated aromatic hydrocarbons [styrene and derivatives thereof {styrenes substituted by hydrocarbons containing 1 to 20 carbon atoms (alkyl, allyl, etc.) (α-methyl styrene, vinyl toluene, 2,4-dimethyl styrene, 4-ethyl styrene, 4-isopropyl styrene, 4-butyl styrene, 4-phenyl styrene, 4-cyclohexyl styrene, 4-benzyl styrene, 4-crotylbenzene, etc.), etc.}, polycyclic aromatic monovinyl monomers (4-vinyl biphenyl, 3-vinyl biphenyl, 2-vinyl biphenyl, 1- or 2-vinyl naphthalene, 1- or 2-vinyl anthracene, etc.), and the like].

(aZ6); Epoxy group-containing unsaturated monomers [epoxy group-containing acrylic monomers {glycidyl (meth) acrylate, etc.}, epoxy group-containing alkenyl (carbon atoms 2 to 10, preferably 3 to 6) ethers {glycidyl(meth)allyl ether, etc.}, and the like].

(aZ7); Halogen atom-containing unsaturated monomers [vinyl or vinylidene halogenated products (vinyl chloride, vinyl bromide, vinylidene chloride, etc.), alkenyl (carbon atoms 3 to 6) halogenated products {(meth)allyl chloride, etc.}, halogen-substituted styrenes {(di)chlorostyrene, etc.}, and the like].

(aZ8); Alkylalkenyl ethers [alkyl(carbon atoms 1 to 10)alkenyl(carbon atoms 2 to 10) ethers {alkylvinyl ethers (methylvinyl ether, n-propylvinyl ether, ethylvinyl ether, etc.), alkyl (meth)allyl ethers (methylallyl ether, ethylallyl ether, etc.), alkyl(iso)propenyl ethers (methylpropenyl ether, ethylisopropenyl ether, etc.)}, and the like].

(aZ9); Alkenyl carboxylates [vinyl acetate, vinyl propionate, vinyl butyrate, vinyl hexanoate, vinyl heptanoate, vinyl 2-ethyl hexanoate, vinyl n-octanoate, etc.].

(aZ10); Unsaturated dicarboxylic acid dialkyl esters [dialkyl esters, dicycloalkyl esters or diaralkylesters of unsaturated dicarboxylic acids (alkyl groups contain 1 to 40 (preferably 1 to 20) carbon atoms) (maleic acid, fumaric acid, itaconic acid, citraconic acid, etc.) {maleate, fumarate, or itaconate of dimethyl, diethyl or dioctyl, etc,}, and the like]

The monomers (aX-1) to (aX-5) and the monomers (aZ) optionally used where necessary may be used alone or two or more of them may be used as a mixture. In the case of copolymers, either structure of random copolymer or block copolymer may be used.

When the monomers (aZ) are used, the mole ratio between (aX-1), (aX-2), (aX-3), (aX-4) or (aX-5), and (aZ) {(aX-1), (aX-2), (aX-3), (aX-4) or (aX-5)/(aZ)} is preferably (1 to 99)/(99 to 1), more preferably (10 to 90)/(90 to 10), particularly preferably (20 to 85)/(80 to 15), most preferably (30 to 80)/(70 to 20).

As specific examples of the polymers (A2-1-1), there may be mentioned a polystyrene sulfonic acid, styrene/styrene sulfonic acid copolymer, poly{2-(meth)acryloylamino-2,2-dimethylethanesulfonic acid}, 2-(meth)acryloylamino-2,2-dimethylethanesulfonic acid/styrene copolymer, 2-(meth) acryloylamino-2,2-dimethylethanesulfonic acid/acrylamide copolymer, 2-(meth)acryloylamino-2,2-dimethylethanesulfonic acid/styrene/acrylamide copolymer, and the like.

As specific examples of the polymers (A2-2-1), there may be mentioned poly{2-hydroxyethyl(meth)acrylate sulfate}, 2-hydroxyethyl acrylate/2-hydroxyethyl acrylate sulfate copolymer, 2-hydroxyethyl methacrylate/2-hydroxyethyl methacrylate sulfate copolymer, and the like.

As specific examples of the polymers (A2-3-1), there may be mentioned poly{2-hydroxyethyl(meth)acrylate phosphate}, 2-hydroxyethyl acrylate/2-hydroxyethyl acrylate phosphate copolymer, 2-hydroxyethyl methacrylate/2-hydroxyethyl methacrylate phosphate copolymer, and the like.

As specific examples of the polymers (A2-4-1), there may be mentioned poly{(meth)acryloyloxyethyl phosphate}, 2-hydroxyethyl acrylate/acryloyloxyethyl phosphate copolymer, 2-hydroxyethyl methacrylate/methacryloyloxyethyl phosphate copolymer, and the like.

As specific examples of the polymers (A2-5-1), there may be mentioned poly(meth)acrylic acid, (meth)acrylic acid/vinyl acetate copolymer, 2-hydroxyethyl methacrylate/(meth) acrylic acid copolymer, and the like.

As a method of synthesizing the polymers obtainable by radical polymerization using an unsaturated monomer (A2-1-1) to (A2-5-1), well-known radical polymerization methods can be used.

For example, the polymers are obtainable by carrying out polymerization at 30 to 150° C. in a solvent such as water or an alcohol solvent using monomers comprising the monomers (aX-1) to (aX-5) and optionally the other radically polymerizable unsaturated monomer (aZ), and a radical initiator (persulfate, azobis amidinopropane salt, azobis isobutylonitrile, etc.) in 0.1 to 30% by weight to the monomers. Where necessary, a chain transfer agent such as mercaptane may be used.

The polymers obtainable by introducing a sulfonic acid group by a polymer reaction (A2-1-2) include sulfonation products of polymers having an unsaturated bond (A2-1-2-1), and the like are included.

Examples of the polymers having an unsaturated bond (A2-1-2-1) include polymers obtainable by a radical polymerization method using butadiene, isoprene, a hydroxyl group-containing aromatic monomer (aZ2-5), amino group-containing aromatic monomer (aZ4-1-3) or unsaturated aromatic hydrocarbon (aZ5-3), and the like. At this time, these butadiene, isoprene, monomers (aZ2-5), (aZ4-1-3) and (aZ5-3) may be used alone or two or more of them may be used as a mixture. Moreover, in addition to these monomers, among the other radically polymerizable unsaturated monomers (aZ), butadiene, isoprene, monomers other than (aZ2-5), (aZ4-1-3) and (aZ5-3) may be copolymerized. In the case of copolymers, either a random copolymer or block copolymer may be used.

As specific examples of the polymers (A2-1-2), there may be mentioned a sulfonation product of polystyrene, sulfonation product of an isoprene/styrene copolymer, and the like.

In view of the solubility in water and the like, the sulfonation ratio (mol %) of the polymers (A2-1-2) per constitutive monomer unit is preferably 50 to 100, more preferably 80 to 99. The sulfonation ratio is an index showing the number of sulfonic acid groups introduced per constitutive monomer unit in the polymers (A2-1-2). For example, in the case of a sulfonation product of polystyrene, the sulfonation ratio of 100% means that one sulfonic acid group is introduced to every aromatic ring in polystyrene. The sulfonation ratio can be determined by well-known methods, for example, a method comprising determining the ratio between carbon atoms and sulfur atoms by ultimate analysis, or a method comprising determining the amount of bonded sulfuric acid (quantitation of anionic surfactants described in JIS K 3362, 1998: corresponding to ISO 2271).

The polymers obtainable by introducing a sulfuric acid group by a polymer reaction (A2-2-2) include a sulfate of hydroxyl group-containing polymers (A2-2-2-1), and the like.

The hydroxyl group-containing polymers (A2-2-2-1) include polymers obtainable by a radical polymerization method using hydroxyl group-containing monomers (aZ2), high molecular polyhydric alcohols selected from a dehydrated condensate of (E2) aliphatic polyhydric alcohols mentioned below, (E4) polysaccharides and derivatives thereof, (E7) novolac resins and (E8) polyphenols, and the like.

The hydroxyl group-containing monomers (aZ2) may be used alone or two or more of them may be used as a mixture. Moreover, in addition to (aZ2), monomers among the other radically polymerizable unsaturated monomers (aZ) other than (aZ2) may be copolymerized. In the case of copolymers, either structure of a random copolymer or block copolymer may be used.

As specific examples of the polymers (A2-2-2), there may be mentioned a sulfate of poly{2-hydroxyethyl(meth)acrylate}, a sulfate of cellulose, methyl cellulose or ethyl cellulose, and the like.

The sulfuric esterification ratio (mol %) is preferably 50 to 100, more preferably 80 to 99 in view of the solubility in water and the like.

In addition, the sulfuric esterification ratio (mol %) can be expressed as a ratio between the hydroxyl group content (number of moles) of the hydroxyl group-containing polymers (A2-2-2-1) and the sulfuric acid group content (number of moles) of the obtained polymers (A2-2-2).

The hydroxyl group content in the hydroxyl group-containing polymers (A2-2-2-1) can be determined according to the hydroxyl value determination method described in JIS K 0070-1992, and the sulfuric acid group content can be obtained in the same manner as in the case of the sulfonation ratio.

The polymers obtainable by introducing a phosphoric acid group by a polymer reaction (A2-3-2) include phosphates of the hydroxyl group-containing polymers (A2-2-2-1), and the like.

As specific examples of the polymers (A2-3-2), there may be mentioned a phosphate of poly{2-hydroxyethyl(meth) acrylate}, a phosphate of cellulose, methyl cellulose or ethyl cellulose, and the like.

The phosphation ratio (mol %) in the polymers (A2-3-2) is preferably 30 to 100, more preferably 50 to 90 in view of the solubility in water, and the like.

In addition, the phosphation ratio (mol %) can be expressed as a ratio between the hydroxyl group content (number of moles) of the hydroxyl group-containing polymers (A2-2-2-1) and the phosphoric acid group content (number of moles) of the obtained polymers (A2-3-2).

The phosphoric acid group content of the obtained polymers (A2-3-2) can be calculated by a ratio between carbon atoms and phosphorus atoms by ultimate analysis. In addition, the phosphates to be obtained may be either monoesters or diesters. When both monoesters and diesters are contained, the mole ratio (d/m) between the monoester (m) and diester (d) is preferably (5 to 50)/(50 to 95), more preferably (10 to 30)/(70 to 90). This mole ratio can be determined using the integral ratio of $^{31}$P-NMR.

The polymers obtainable by introducing a phosphonic acid group by a polymer reaction (A2-4-2) include phosphonation products of polymers having an unsaturated bond (A2-1-2-1), and the like.

As specific examples of the polymers (A2-4-2), there may be mentioned phosphonation products of polystyrene, and the like.

The phosphonation ratio (mol %) in the polymers (A2-4-2) is preferably 50 to 100, more preferably 80 to 99 in view of the solubility in water, and the like.

In addition, the phosphonation ratio is an index showing the number of phosphonic acid groups introduced per constitutive monomer unit in the polymers (A2-4-2). For example, in the case of a phosphonation product of polystyrene, the phosphonation ratio of 100% means that one phosphonic acid group is introduced to every aromatic ring in polystyrene. The phosphonation ratio can be determined by well-known methods, and a method comprising determining the ratio between carbon atoms and phosphorus atoms by ultimate analysis, and the like can be used.

The polymers obtainable by introducing a carboxyl group by a polymer reaction (A2-5-2) include carboxymethylation products of the hydroxyl group-containing polymers (A2-2-2-1), and the like.

As specific examples of the polymers (A2-5-2), there may be mentioned a carboxymethylation product of poly{2-hydroxyethyl(meth)acrylate}, carboxymethylcellulose, carboxymethylmethylcellulose, carboxymethylethylcellulose, and the like.

The carboxymethylation ratio (mol %) relative to the whole hydroxyl group content in the polymers (A2-5-2) is preferably 10 to 100, more preferably 20 to 70 in view of the solubility in water, and the like.

In addition, the carboxymethylation ratio (mol %) can be expressed as a ratio between the hydroxyl group content (number of moles) of the hydroxyl group-containing polymers (A2-2-2-1) and the carboxyl group content (number of moles) of the obtained polymers (A2-5-2).

The carboxyl group content can be determined according to the acid value determination method described in JIS K 0070-1992.

For the method of synthesizing the polymers (A2-1-2), a method comprising obtaining polymers having an unsaturated bond (A2-1-2-1) by the same radical polymerization method as in the case of the polymers (A2-1-1) to (A2-5-1) using the hydroxyl group-containing aromatic monomers (aZ2-5), amino group-containing aromatic monomers (aZ4-1-3) or unsaturated aromatic hydrocarbons (aZ5-3), and where necessary, other radically polymerizable unsaturated monomers (aZ), and then carrying out well-known sulfonation reaction, and the like, can be used.

For the sulfonation reaction method, for example, a sulfonation product can be obtained by charging a reaction solvent (e.g. a solvent which is inactive to sulfonation such as 1,2-dichloroethane, methylene dichloride, ethyl chloride, carbon tetrachloride, 1,1-dichloroethane, 1,1,2,3-tetrachloroethane, chloroformandethylenedibromide), a sulfonation agent (e.g. anhydrous sulfate, chlorosulfonic acid, etc.), reacting the mixture at 0 to 50° C., and where necessary filtrating and distilling off the solvent. The level (mole ratio) of use of the sulfonation agent at this time is preferably 0.5 to 3, more preferably 1 to 2.5 based on the number of moles of the hydroxyl group-containing aromatic monomers (aZ2-5), amino group-containing aromatic monomers (aZ4-1-3) and unsaturated aromatic hydrocarbons (aZ5-3). The level (% by weight) of use of the solvent is usually 1 to 30, preferably 2 to 20 relative to the polymer materials, although it depends on the molecular weight of said polymer materials.

The surfactant of the present invention may be directly obtained by adding the nitrogen-containing basic compound (B), an aqueous solution of (B) or a solution of (B) in the below-mentioned water-soluble solvent (D) to the polymer solution after the reaction, neutralizing the mixture, and then where necessary separating water or the solvent (D) by filtration or distillation in order to obtain the neutralized salt (AB2), (hereinafter, the cases of using the polymers (A2-2-2), polymers (A2-3-2), polymers (A2-4-2), and polymers (A2-5-2) are also the same).

As the method of synthesizing the polymers (A2-2-2), a method comprising sulfuric esterification of hydroxyl group-containing polymers (A2-2-2-1) by well-known sulfuric esterification reaction, and the like, can be used.

As the sulfuric esterification reaction, for example, well-known methods comprising using a reaction solvent (e.g. aliphatic hydrocarbons such as n-hexane and cyclohexane, aromatic hydrocarbons such as toluene, the reaction solvents exemplified in the above sulfonation reaction, etc.), and sulfuric esterification agents (V1) to (V4) can be used. For example, there may be mentioned a method comprising using (V1) chlorosulfonic acid, a method comprising using (V2) sulfan, a method comprising using (V3) sulfamic acid, a method comprising using (V4) sulfuric acid, and the like. In addition, (V2) sulfan is usually used after dilution to about 1 to 30% by volume by dry nitrogen, etc. The reaction temperature is usually 0 to 70° C., preferably 10 to 50° C. in the cases of (V1) and (V2), and in the cases of (V3) and (V4), it is usually 50 to 150° C., preferably 60 to 130° C. The level (mole ratio) of use of these sulfuric esterification agents is preferably 1 to 3, more preferably 1.5 to 2.5 based on the number of moles of hydroxyl groups in the hydroxyl group-containing polymers (A2-2-2-1).

As the method of synthesizing the polymers (A2-3-2), a method comprising phosphation of hydroxyl group-containing polymers (A2-2-2-1) by well-known phosphation reaction, in the same manner as in the case of the polymers (A2-2-2), and the like, can be used.

As the phosphation reaction, well-known methods comprising using phosphation agents (phosphorus oxyhalide, diphosphorus pentaoxide, etc.) can be used. This phosphation reaction can be carried out under nitrogen atmosphere without solvent, but a solvent such as acetonitrile, 1,4-dioxane, tetrahydrofuran, dimethylformamide (DMF), dimethylsulfoxide (DMSO), carbon tetrachloride and chloroform may be used. The reaction temperature depends on the phosphation agent to be used, but usually −30 to 150° C., preferably 20 to 50° C. The level (mole ratio) of use of the phosphation agent is preferably 0.8 to 1.5, more preferably 0.95 to 1.1 when phosphate monoester is used as a main component, and is preferably 1.7 to 2.5, more preferably 1.8 to 2.2 when phosphate diester is used as a main component, based on the number of moles of hydroxyl groups in the polymers (A2-2-2-1).

As the method of synthesizing the polymers (A2-4-2), a method comprising phosphonation of polymers having an unsaturated bond (A2-1-2-1) by well-known phosphonation reaction, in the same manner as in the case of the polymers (A2-1-2), and the like, can be used.

As the phosphonation reaction method, well-known methods can be used. For example, there may be mentioned (P1) a method comprising reacting the polymers with chloromethyl ether, etc. in the presence of anhydrous aluminum chloride, introducing a halomethyl group into the aromatic ring, adding phosphorus trichloride and anhydrous aluminum chloride thereto, and further introducing a phosphonic acid group by a hydrolysis reaction, and (P2) a method comprising reacting the polymers by adding phosphorus trichloride and anhydrous aluminum chloride, introducing a phosphinic acid group into the aromatic ring, and then oxidizing the phosphinic acid groups by nitric acid to obtain phosphonic acid groups. The reaction temperature is usually 10 to 150° C., preferably 40 to 100° C. The level (mole ratio) of use of the phosphonation agent is preferably 0.5 to 3, more preferably 1 to 2.5 based on the number of moles of the hydroxyl group-containing aromatic monomers (aZ2-5), the amino group-containing aromatic monomers (aZ4-1-2), and the unsaturated aromatic hydrocarbons (aZ5-3).

As the method of synthesizing the polymers (A2-5-2), a method comprising carboxymethylation of hydroxyl group-containing polymers (A2-2-2-1) by well-known carboxymethylation reaction, in the same manner as in the case of the polymers (A2-2-2), and the like, can be used.

As the carboxymethylation reaction method, there may be mentioned, for example, a method comprising dechlorinating the polymers in the presence of a monohalogenated lower carboxylate such as sodium monochloroacetate, caustic alkali (potassium hydroxide, etc.), and where necessary a solvent (toluene, etc.) under nitrogen atmosphere, and the like. The reaction temperature is usually 30 to 100° C., preferably 40 to 70° C.

As the sulfonic acid group-containing aromatic compounds (aY-1) to be used in synthesizing the polymers (A2-1-3), there may be mentioned arylsulfonic acids (benzenesulfonic acid, etc.), alkyl (carbon atoms 1 to 24) arylsulfonic acids (toluenesulfonic acid, dodecylbenzenesulfonic acid, monobutylbiphenylsulfonic acid, etc.), polycyclic aromatic sulfonic acids (naphthalene sulfonic acid, anthracene sulfonic acid, hydroxynaphthalene sulfonic acid, hydroxyanthracene sulfonic acid, etc.), alkyl (carbon atoms 1 to 24)-substituted polycyclic aromatic sulfonic acids {alkyl (carbon atoms 1 to 24) naphthalene sulfonic acids (methylnaphthalene sulfonic acid, dimethylnaphthalene sulfonic acid, isopropylnaphthalene sulfonic acid, butylnaphthalene sulfonic acid, octylnaphthalene sulfonic acid, laurylnaphthalene sulfonic acid, eicosylnaphthalene sulfonic acid, etc.), methylanthracene sulfonic acid, laurylanthracene sulfonic acid, eicosylanthracene sulfonic acid, etc.}, phenol sulfonic acids (phenol sulfonic acid, monobutyl phenylphenol monosulfonic acid, dibutylphenylphenol disulfonic acid, etc.), alkyl (carbon atoms 1 to 24) phenol sulfonic acids (cresol sulfonic acid, nonylphenol sulfonic acid, eicosylphenol sulfonic acid, etc.), aromatic aminosulfonic acids (aniline sulfonic acid, etc.), lignin sulfonic acids (lignin sulfonate, modified lignin sulfonic acid), sulfonic acid group-containing compounds having a triazine ring (melamine sulfonic acid, etc.), and the like.

Among these, in view of the readhesion prevention ability and the like, preferred are alkyl (carbon atoms 1 to 24) arylsulfonic acids, polycyclic aromatic sulfonic acids, alkyl (carbon atoms 1 to 24)-substituted polycyclic aromatic sulfonic acids, and more preferred are dodecylbenzenesulfonic acid, naphthalene sulfonic acid and dimethylnaphthalene sulfonic acid.

As the phosphonic acid group-containing aromatic compounds (aY-4) to be used in synthesizing the polymers (A2-4-3), there may be mentioned arylphosphonic acids (benzenephosphonic acid, etc.), alkyl (carbon atoms 1 to 24) arylphosphonic acids (toluenephosphonic acid, dodecylbenzenephosphonic acid, monobutylbiphenylphosphonic acid, etc.), polycyclic aromatic phosphonic acids (naphthalene phosphonic acid, anthracene phosphonic acid, hydroxynaphthalene phosphonic acid, hydroxyanthracene phosphonic acid, etc.), alkyl (carbon atoms 1 to 24)-substituted polycyclic aromatic phosphonic acids {alkyl (carbon atoms 1 to 24) naphthalene phosphonic acid (methylnaphthalene phosphonic acid, dimethylnaphthalene phosphonic acid, isopropylnaphthalene phosphonic acid, butylnaphthalene phosphonic acid, laurylnaphthalene phosphonic acid, eicosylnaphthalene phosphonic acid, etc.), methylanthracene phosphonic acid, laurylanthracene phosphonic acid, eicosylanthracene phosphonic acid, etc.}, phenol phosphonic acids (phenol phosphonic acid, monobutylphenylphenol monophosphonic acid, dibutylphenylphenol diphosphonic acid, etc.), alkyl (carbon atoms 1 to 24) phenol phosphonic acids (cresol phosphonic acid, nonylphenol phosphonic acid, eicosylphenol phosphonic acid, etc.), aromatic aminophosphonic acids (aniline phosphonic acid, etc.), and the like.

Among these, in view of the readhesion prevention ability and the like, preferred are alkyl (carbon atoms 1 to 24) arylphosphonic acid, polycyclic aromatic phosphonic acid and alkyl (carbon atoms 1 to 24)-substituted polycyclic aromatic phosphonic acid, and more preferred are dodecylbenzenephosphonic acid, naphthalene phosphonic acid and dimethylnaphthalene phosphonic acid.

As the carboxyl group-containing aromatic compounds (aY-5) to be used in synthesizing the polymers (A2-5-3), there may be mentioned aryl carboxylic acids (benzoic acid, hydroxybenzoic acid, isophthalic acid, etc.), polycyclic aromatic carboxylic acids (naphthalene carboxylic acid, naphthalene dicarboxylic acid, 4,5-phenanthrene dicarboxylic acid, anthracene carboxylic acid, oxynaphthoic acid, etc.), and the like.

Among these, in view of polycondensation property, benzoic acid and hydroxybenzoic acid are preferred.

Other than the sulfonic acid group-containing aromatic compounds (aY-1), phosphonic acid group-containing aromatic compounds (aY-4), and carboxyl group-containing aromatic compounds (aY-5), the polymers (A2-1-3), (A2-4-3) and (A2-5-3) may comprise, where necessary, other aromatic compounds (aO), urea, and the like as a constitutent component.

As the other aromatic compounds (aO), there may be mentioned benzene, alkyl benzene (carbon atoms of the alkyl group: 1 to 20), naphthalene, alkyl naphthalene (carbon atoms of the alkyl group: 1 to 20), phenol, cresol, hydroxynaphthalene, aniline, and the like.

As specific examples of the polymers (A2-1-3), there may be mentioned a naphthalene sulfonic acid formaldehyde condensate, methylnaphthalene sulfonic acid formaldehyde condensate, dimethylnaphthalene sulfonic acid formaldehyde condensate, octylnaphthalene sulfonic acid formaldehyde condensate, naphthalene sulfonic acid-methylnaphthalene-formaldehyde condensate, naphthalene sulfonic acid-octylnaphthalene-formaldehyde condensate, hydroxynaphthalene sulfonic acid formaldehyde condensate, hydroxynaphthalene sulfonic acid-cresolsulfonic acid-formaldehyde condensate, anthracene sulfonic acid formaldehyde condensate, melamine sulfonic acid formaldehyde condensate, aniline sulfonic acid-phenol-formaldehyde condensate, and the like.

As specific examples of the polymers (A2-4-3), there may be mentioned a naphthalene phosphonic acid formaldehyde condensate, methylnaphthalene phosphonic acid formaldehyde condensate, dimethylnaphthalene phosphonic acid formaldehyde condensate, anthracene phosphonic acid formaldehyde condensate, aniline phosphonic acid-phenol-formaldehyde condensate, and the like.

As specific examples of the polymers (A2-5-3), there may be mentioned a benzoic acid formaldehyde condensate, benzoic acid-phenol-formaldehyde condensate, and the like.

As a method of synthesizing the polymers (A2-1-3), (A2-4-3) and (A2-5-3), well-known methods can be used. For example, there may be mentioned a method comprising charging the sulfonic acid group-containing aromatic compound (aY-1), phosphonic acid group-containing aromatic compound (aY-4) or carboxyl group-containing aromatic compound (aY-5), and optionally other compounds (aO), urea and an acid (sulfuric acid, etc.) or alkali (sodium hydroxide, etc.) as a catalyst into a reactor, dropping a formalin solution at the predetermined amount (e.g. 37% by weight aqueous solution at 70 to 90° C. under stirring) for 1 to 4 hours, and after that, stirring the mixture under reflux condition for 3 to 30 hours and cooling.

Moreover, it is possible to neutralize a part or all of sulfonic acid groups, phosphonic acid groups or carboxyl groups in the compound (aY-1), (aY-4) or (aY-5) with nitrogen-containing basic compounds (B) to synthesize the polymers (A2-1-3), (A2-4-3) and (A2-5-3), and also to obtain the neutralized salt (AB2) directly at the same time.

When other compounds (aO) are used, the mole ratio between (aY-1), (aY-4) or (aY-5) and (aO) {(aY-1), (aY-4) or (aY-5)/(aO)} is preferably (1 to 99)/(99 to 1), more preferably (10 to 90)/(90 to 10), particularly preferably (30 to 85)/(70 to 15), most preferably (50 to 80)/(50 to 20).

When urea is used, the mole ratio between (aY-1), (aY-4) or (aY-5) and urea {(aY-1), (aY-4) or (aY-5)/urea} is preferably (1 to 99)/(99 to 1), more preferably (10 to 90)/(90 to 10), particularly preferably (30 to 85)/(70 to 15), most preferably (50 to 80)/(50 to 20).

Moreover, (aY-1), (aY-4), (aY-5) or (aO) may be used as a mixture of two or more species.

The pKa of the polymers (A2) is preferably not more than 8.0, and in view of lowering the zeta potential, and the like, it is more preferably not more than 7.0, particularly preferably not more than 5.5, most preferably not more than 3.0. The pKa can be determined by the above-mentioned method.

The weight average molecular weight (hereinafter abbreviated as Mw) of the polymer (A2) is preferably 300 to 800,000, more preferably 600 to 400,000, particularly preferably 1,000 to 80,000, most preferably 2,000 to 40,000 in view of the readhesion prevention ability, low foamability, and the like.

The above weight average molecular weight is a value determined by gel permeation chromatography (hereinafter abbreviated as GPC) at 40° C. using polyethylene oxide as a reference material. For example, device: HLC-8120 manufactured by Tosoh Corporation, column: TSKgel G5000 PWXL, G3000 PW XL manufactured by Tosoh Corporation, detector: a differential refractometry detector built in the device, eluent: 0.2 M anhydrous sodium sulfate, 10% acetonitrile buffer solution, eluent flow rate: 0.8 ml/min., column temperature: 40° C., sample: 1.0% by weight solution in the eluent, injection amount: 100 μl, reference material: TSK SE-30, SE-15, SE-8 and/or SE-5 manufactured by Tosoh Corporation.

Next, the nitrogen-containing basic compounds (B) of the neutralized salts (AB1) and (AB2) are explained.

In the practice of the present invention, as the nitrogen-containing basic compounds (B), those having the difference of heat of formation in a proton addition reaction (Q2) of 10 to 152 kcal/mol are used.

In the present invention, the difference of heat of formation in a proton addition reaction (Q2) refers to a difference between the heat of formation of B and the heat of formation of $H^+B$ in the proton addition reaction of the nitrogen-containing basic compounds (B) represented by the following formula (5).

$$B+H^+ \rightarrow H^+B \tag{5}$$

That is, Q2 is represented by the following formula (7):

$$Q2=\Delta_f H^o_{H+B}-\Delta_f H^o_B \tag{7}$$

[in the formula, $\Delta_f H^o_{H+B}$ and $\Delta_f H^o_B$ each represents the heat of formation of $H^+B$ and B in vacuum, respectively].

The value of the heat of formation ($\Delta_f H^o$) can be calculated using the semiempirical molecular orbital method (MOPAC PM3 method) as mentioned above.

In addition, the position to which $H^+$ is added when the heat of formation of $H^+B$ is calculated is on a nitrogen atom contained in the compounds (B). When a plurality of nitrogen atoms occurs, the heat of formation is calculated for each nitrogen atom, and the value at which the difference between the heat of formation of B and the heat of formation of $H^+B$ is minimum is determined as the difference of the heat of formation (Q2).

The difference of the heat of formation in a proton addition reaction (Q2) (kcal/mol, 25° C.) of the compounds (B) is 10 to 152, and in view of lowering the zeta potential, and the like, it is preferably 30 to 148, more preferably 40 to 145, still more preferably 50 to 143, particularly preferably 90 to 140, most preferably 100 to 138.

Provide that said difference of the heat of formation in a proton addition reaction (Q2) being within the range of 10 to 152 kcal/mol, the nitrogen-containing basic compounds (B) include, for example, compounds containing at least one guanidine skeleton within the molecule (B-1), compounds containing at least one amidine skeleton within the molecule (B-2), compounds containing at least one N═P—N skeleton within the molecule (B-3), proton sponge derivatives (B-4), and the like.

The molecular volume ($nm^3$) of the compounds (B) is preferably 0.025 to 0.7, and in view of lowering the zeta potential, and the like, it is more preferably 0.050 to 0.5, particularly preferably 0.12 to 0.36.

Herein, the molecular volume refers to the volume of space occurring on the electron density isosurface of the molecule, and can be obtained from an optimized structure calculated using MM2 (Allinger, N.L., J. Am. Chem. Soc., 99, 8127 (1977)), which is a molecular force field method, and PM3 (Stewart, J. J. P., J. Am. Chem. Soc., 10, 221 (1989)), which is a semiempirical molecular orbital method. For example, it can be obtained by optimizing the structure in the same manner using the above-mentioned "CAChe Worksystem 6.01" manufactured by FUJITSU, LTD., and then calculating with "PM3 geometry", which is a semiempirical molecular orbital method, on "Project Leader". In addition, when plural values of molecular volume are obtained as a result of calculation, the maximum value is used.

As specific examples of the compounds (B-1), there may be mentioned guanidines {guanidine (Q2=147 kcal/mol, molecular volume=0.062 $nm^3$), methyl guanidine (Q2=144 kcal/mol, molecular volume=0.084 $nm^3$), tetramethyl guanidine (Q2=145 kcal/mol, molecular volume=0.147 $nm^3$), ethyl guanidine (Q2=142 kcal/mol, molecular volume=0.104 $nm^3$), phenyl guanidine (Q2=141 kcal/mol, molecular volume=0.139 $nm^3$), etc.}, monocyclic guanidines [2-amino-imidazole {2-amino-1H-imidazole (Q2=146 kcal/mol, molecular volume=0.080 $nm^3$), 2-dimethylamino-1H-imidazole (Q2=138 kcal/mol, molecular volume=0.113 $nm^3$), 2-amino-4,5-dihydro-1H-imidazole (Q2=147 kcal/mol, molecular volume=0.113 $nm^3$), 2-dimethylamino-4,5-dihydro-1H-imidazole (Q2=143 kcal/mol, molecular volume=0.133 $nm^3$), etc.}, 2-amino-tetrahydropyrimidines {2-amino-1,4,5,6-tetrahydro-pyrimidine (Q2=145 kcal/mol, molecular volume=0.113 $nm^3$), 2-dimethylamino-1,4,5,6-tetrahydro-pyrimidine (Q2=140 kcal/mol, molecular volume=0.152 $nm^3$), etc.}, 2-amino-dihydropyrimidines {2-amino-1, 6 (4)-dihydropyrimidine (Q2=147 kcal/mol, molecular volume=0.113 $nm^3$), 2-dimethylamino-1,6(4)-dihydropyrimidine (Q2=143 kcal/mol, molecular volume=0.142 $nm^3$), etc.}, polycyclic guanidines {1,3,4,6,7,8-hexahydro-2H-pyrimido[1,2-a]pyrimidine (hereinafter abbreviated as TBD) (Q2=147 kcal/mol, molecule volume 0.159 $nm^3$), 1,3,4,6,7,8-hexahydro-1-methyl-2H-pyrimido[1,2-a]pyrimidine (hereinafter abbreviated as MTBD) (Q2=139 kcal/mol, molecular volume=0.180 $nm^3$), etc.}, and the like.

Preferred as the compound (B-1) are guanidine, 1,3,4,6,7,8-hexahydro-2H-pyrimido[1,2-a]pyrimidine, and 1,3,4,6,7,8-hexahydro-1-methyl-2H-pyrimido[1,2-a]pyrimidine.

As specific examples of the compounds (B-2), there may be mentioned imidazoles {1H-imidazole (Q2=147 kcal/mol, molecular volume=0.067 $nm^3$), 2-methyl-1H-imidazole (Q2=144 kcal/mol, molecular volume=0.113 $nm^3$), 2-ethyl-1H-imidazole (Q2=143 kcal/mol, molecular volume=0.113 $nm^3$), 4,5-dihydro-1H-imidazole (Q2=147 kcal/mol, molecular volume=0.113 $nm^3$), 2-methyl-4,5-dihydro-1H-imidazole (Q2=147 kcal/mol, molecular volume=0.113 $nm^3$), 2-ethyl-4,5-dihydro-1H-imidazole (Q2=145 kcal/mol, molecular volume=0.119 $nm^3$), etc.}, tetrahydropyrimidines {1,4,5,6-tetrahydropyrimidine (Q2=151 kcal/mol, molecular volume=0.113 $nm^3$), 2-methyl-1,4,5,6-tetrahydropyrimidine (Q2=148 kcal/mol, molecular volume=0.119 $nm^3$), dihydropyrimidine {1,6 (4)-dihydropyrimidine (Q2=147 kcal/mol, molecular volume=0.088 $nm^3$), 2-methyl-1, 6 (4)-dihydropyrimidine (Q2=143 kcal/mol, molecular volume=0.113 $nm^3$), etc.}, bicyclic amidine represented by the following general formula (15), and the like.

(15)

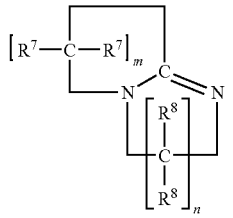

{In the formula, $R^7$ and $R^8$ each independently represents hydrogen atom, an alkyl group containing 1 to 24 carbon atoms, alkenyl group containing 2 to 24 carbon atoms, alkynyl group containing 2 to 30 carbon atoms, aryl group containing 6 to 30 carbon atoms, arylalkyl group containing 7 to 30 carbon atoms, and a part or all of hydrogen atoms in the alkyl group, alkenyl group, alkynyl group, aryl group and arylalkyl group may be further substituted by a hydroxyl group, amino group, (di)alkyl (carbon atoms 1 to 24) amino group, (di)hydroxyalkyl (carbon atoms 2 to 4) amino group, mercapto group or a halogen atom (fluorine atom, chlorine atom, bromine atom, and iodine atom). Moreover, two $R^7$ s and two $R^8$s may be the same or different, or may be bound together (a carbon-carbon bond, ether bond, etc.) to form a ring containing 4 to 12 carbon atoms. m and n each independently represents an integer of 1 to 12.}

As the alkyl group containing 1 to 24 carbon atoms or the alkenyl group containing 2 to 24 carbon atoms, there may be mentioned those containing 1 to 24 carbon atoms or those containing 2 to 24 carbon atoms among the alkyl groups and alkenyl groups exemplified as the hydrophobic groups (Y).

The alkynyl group containing 2 to 30 carbon atoms may be either straight chain or branched one, and there may be mentioned ethynyl, 1-propynyl, 2-propynyl, 1- or 2-dodecynyl, 1- or 2-tridecynyl, 1- or 2-tetradecynyl, 1- or 2-hexadecynyl, 1- or 2-stearynyl, 1- or 2-nonadecynyl, 1- or 2-eicosynyl, 1- or 2-tetracosynyl, and the like.

As the aryl group containing 6 to 30 carbon atoms, there may be mentioned phenyl, tolyl, xylyl, naphthyl, methyl naphthyl, and the like.

As the arylalkyl group containing 7 to 30 carbon atoms, there may be mentioned benzyl, 2-phenylethyl, 3-phenylpropyl, 4-phenylbutyl, 5-phenylpentyl, 6-phenylhexyl, 7-phenylheptyl, 8-phenyloctyl, 10-phenyldecyl, 12-phenyldodecyl, naphthylmethyl, naphthylethyl, and the like.

When two $R^7$s or two $R^8$s are bound each other to form a ring containing 4 to 12 carbon atoms, those two $R^7$s or two $R^8$s form a divalent organic group (alkylene group containing 4 to 12 carbon atoms, etc.).

As the alkylene group containing 4 to 12 carbon atoms, there may be mentioned butylene, pentylene, hexylene, heptylene, octylene, decylene, dodecylene, and the like, and these alkylene groups may be bounded via an ether bond, etc.

As specific examples of the compound represented by the general formula (15), there may be mentioned 1,8-diazabicyclo[5.4.0]undecene-7 (hereinafter abbreviated as DBU; DBU is a registered trademark of San-Apro Ltd.) (Q2=137 kcal/mol, molecular volume=0.185 $nm^3$), 1,5-diazabicyclo[4.3.0]

nonene-5 (hereinafter abbreviated as DBN) (Q2=141 kcal/mol, molecular volume=0.146 $nm^3$), 1,8-diazabicyclo[5.3.0]decene-7 (Q2=142 kcal/mol, molecular volume=0.166 $nm^3$), 1,4-diazabicyclo[3.3.0]octene-4 (Q2=146 kcal/mol, molecular volume=0.126 $nm^3$), 1,5-diazabicyclo[4.4.0]decene-5 (Q2=143 kcal/mol, molecular volume=0.166 $nm^3$), 6-dimethylamino-1,8-diazabicyclo[5.4.0]undecene-7 (Q2=133 kcal/mol, molecular volume=0.238 $nm^3$), 6-dibutylamino-1,8-diazabicyclo[5.4.0]undecene-7 (Q2=137 kcal/mol, molecular volume=0.355 $nm^3$), 6-(2-hydroxyethyl)-1,8-diazabicyclo[5.4.0]-7-undecene (Q2=139 kcal/mol, molecular volume=0.229 $nm^3$), 6-(2-hydroxypropyl)-1,8-diazabicyclo[5.4.0]-7-undecene (Q2=138 kcal/mol, molecular volume=0.250 $nm^3$), 7-(2-hydroxyethyl)-1,5-diazabicyclo[4.3.0]-5-nonene (Q2=142 kcal/mol, molecular volume=0.192 $nm^3$), 7-(2-hydroxypropyl)-1,5-diazabicyclo[4.3.0]-5-nonene (Q2=142 kcal/mol, molecular volume=0.211 $nm^3$), 6-di(2-hydroxyethyl)amino-1,8-diazabicyclo[5.4.0]-7-undecene (Q2=137 kcal/mol, molecular volume=0.287 $nm^3$), and the like.

As the compounds (B-3), there may be mentioned phosphazene compounds represented by the following general formula (16)

(16)

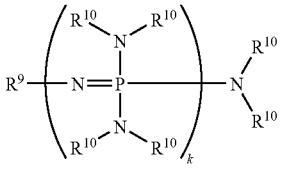

[in the formula, $R^9$ and $R^{10}$ each independently represents a hydrogen atom, an alkyl group containing 1 to 24 carbon atoms, alkenyl group containing 2 to 24 carbon atoms, aryl group containing 6 to 24 carbon atoms, and arylalkyl group containing 7 to 24 carbon atoms; additionally, the hydrogen atom in $R^9$ and $R^{10}$ may be further substituted by an hydroxyl group, amino group, mercapto group or halogen atom (fluorine atom, chlorine atom, bromine atom, iodine atom); a plurality of $R^{10}$s may be the same or different, and adjacent $R^{10}$ s may be bound together (a carbon-carbon bond, ether bond, etc.) to form a ring containing 4 to 12 carbon atoms; k represents an integer of 1 to 4].

As the alkyl group containing 1 to 24 carbon atoms, alkenyl group containing 2 to 24 carbon atoms, aryl group containing 6 to 24 carbon atoms, and arylalkyl group containing 7 to 24 carbon atoms in the general formula (16), there may be mentioned the same ones as the above $R^7$ and $R^8$.

When the adjacent $R^{10}$ s form a ring, two $R^{10}$ s form a divalent organic group in the same manner as in the case of the above $R^7$ and $R^8$.

As specific examples of the compounds represented by the general formula (16), there may be mentioned $H[N{=}P(dma)_2]N(CH_3)_2$ (Q2=122 kcal/mol, molecular volume=0.217 $nm^3$), $Me[N{=}P(dma)_2]N(CH_3)_2$ (Q2=128 kcal/mol, molecular volume=0.237 $nm^3$), $Et[N{=}P(dma)_2]N(CH_3)_2$ (Q2=125 kcal/mol, molecular volume=0.260 $nm^3$), $t\text{-}Bu[N{=}P(dma)_2]N(CH_3)_2$ (Q2=107 kcal/mol, molecular volume=0.298 $nm^3$), $Ph[N{=}P(dma)_2]N(CH_3)_2$ (Q2=129 kcal/mol, molecular volume=0.294 $nm^3$), $CH_3CH{=}CH[N{=}P(dma)_2]N(CH_3)_2$ (Q2=123 kcal/mol, molecular volume=0.270 $nm^3$), $4\text{-}Me\text{-}C_6H_4[N{=}P(dma)_2]N(CH_3)_2$ (Q2=126 kcal/mol, molecular volume=0.311 $nm^3$), $H[N{=}P(pyrr)_2](pyrr)$ (Q2=121 kcal/mol, molecular volume=0.293 $nm^3$), $Me[N{=}P(pyrr)_2](pyrr)$ (Q2=125 kcal/mol, molecular volume=0.314 $nm^3$), $Et[N{=}P(pyrr)_2](pyrr)$ (Q2=123 kcal/mol, molecular volume=0.339 $nm^3$), $t\text{-}Bu[N{=}P(pyrr)_2](pyrr)$ (Q2=122 kcal/mol, molecular volume=0.373 $nm^3$), $Ph[N{=}P(pyrr)_2](pyrr)$ (Q2=123 kcal/mol, molecular volume=0.370 $nm^3$), $4\text{-}Me\text{-}C_6H_4[N{=}P(pyrr)_2](pyrr)$ (Q2=122 kcal/mol, molecular volume=0.390 $nm^3$), and the like. In addition, Me represents methyl, Et represents ethyl, Ph represents phenyl, t-Bu represents t-butyl, (dma) represents dimethylamino, and (pyrr) represents 1-pyrrolidinyl.

As the proton sponge derivatives (B-4), there may be mentioned 1,8-bis(dimethylamino)naphthalene (Q2=138 kcal/mol, molecular volume=0.249 $nm^3$), 1-dimethylamino-8-methylamino-quinolizine (Q2=126 kcal/mol, molecular volume=0.221 $nm^3$), 1-dimethylamino-7-methyl-8-methylamino-quinolizine (Q2=132 kcal/mol, molecular volume=0.240 $nm^3$), 1-dimethylamino-7-methyl-8-methylamino-isoquinoline (Q2=128 kcal/mol, molecular volume=0.242 $nm^3$), 7-methyl-1,8-methylamino-2,7-naphthylidine (Q2=118 kcal/mol, molecular volume=0.211 $nm^3$), 2,7-dimethyl-1,8-methylamino-2,7-naphthylidine (Q2=120 kcal/mol, molecular volume=0.230 $nm^3$), and the like.

As the compounds (B), in view of the zeta potential and the like, preferred are guanidine, methyl guanidine, ethyl guanidine, TBD and MTBD among (B-1), DBU and DBN among (B-2), $H[N{=}P(dma)_2]N(CH_3)_2$, $Me[N{=}P(dma)_2]N(CH_3)_2$, $Et[N{=}P(dma)_2]N(CH_3)_2$, $t\text{-}Bu[N{=}P(dma)_2]N(CH_3)_2$, $Et[N{=}P(dma)_2]_2N(CH_3)_2$, $Ph[N{=}P(dma)_2]N(CH_3)_2$, $H[N{=}P(pyrr)_2](pyrr)$, and $Me[N{=}P(pyrr)_2](pyrr)$ among (B-3), and 1,8-bis(dimethylamino)naphthalene, 1-dimethylamino-8-methylamino-quinolizine, 1-dimethylamino-7-methyl-8-methylamino-isoquinoline, 7-methyl-1,8-methylamino-2,7-naphthylidine among (B-4), more preferred are guanidine, methyl guanidine, ethyl guanidine, TBD, MTBD, DBU and DBN, particularly preferred are TBD, MTBD, DBU and DBN.

The compounds (B) may be used alone or two or more of them may be used as a mixture.

Moreover, the pKa of the compounds (B) is preferably 11 to 40, and in view of lowering the zeta potential and the like, it is more preferably 11.5 to 30, particularly preferably 12 to 25.

In addition, the pKa of the compounds (B) can be obtained by well-known methods {for example, described in Can. J. Chem. 65, 626 (1987)}, and the like.

In the present invention, in the neutralized salt (AB1) of the acidic compound (A1) and compound (B), and the neutralized salt (AB2) of the polymer (A2) and compound (B), it is only required that apart or all of the acid groups (X1) or (X2) are neutralized with (B).

Specific examples of the neutralized salt (AB1) include the following compounds.

Alkylbenzenesulphonates (toluenesulfonic acid guanidine salt, toluenesulfonic acid DBU salt, toluenesulfonic acid DBN salt, xylenesulfonic acid guanidine salt, xylenesulfonic acid DBU salt, xylenesulfonic acid DBN salt, dodecylbenzenesulfonic acid guanidine salt, dodecylbenzenesulfonic acid DBU salt, dodecylbenzenesulfonic acid DBN salt, dodecylbenzenesulfonic acid $Et[N{=}P(dma)_2]_2N(CH_3)_2$ salt, etc.), naphthalenesulfonate (naphthalenesulfonic acid guanidine salt, naphthalenesulfonic acid DBU salt, naphthalenesulfonic acid DBN salt etc.), alkylnaphthalenesulfonates (methylnaphthalenesulfonic acid guanidine salt, methylnaphthalenesulfonic acid DBU salt, methylnaphthalenesulfonic acid DBN salt, dodecylnaphthalenesulfonic acid guanidine salt, dodecylnaphthalenesulfonic acid DBU salt, dodecylnaphthalenesulfonic acid DBN salt, etc.), polyoxyalkylenealkyl ether sulfonates (polyoxyethylenelauryl ether sulfonic acid guanidine salt, polyoxyethylenelauryl ether sulfonic acid DBU salt, polyoxyethylenelauryl ether sulfonic acid DBN salt, etc.), polyoxyalkylenealkylaryl ether sulfonates (polyoxyethyleneoctylphenyl ether sulfonic acid guanidine salt, polyoxyethyleneoctylphenyl ether sulfonic acid DBU salt, polyoxyethyleneoctylphenyl ether sulfonic acid DBN salt, etc.), sulfosuccinates ((di)2-ethylhexyl sulfosuccinic acid guanidine salt, (di)2-ethylhexyl sulfosuccinic acid DBU salt, (di) 2-ethylhexyl sulfosuccinic acid DBN salt etc.), alkyloylaminoethylsulfonic acids (lauryloyl-N-methylaminoethylsulfonic acid guanidine salt, lauryloyl-N-methylaminoethylsulfonic acid DBU salt, lauryloyl-N-methylaminoethylsulfonic acid DBN salt, etc.), and the like.

Specific examples of the neutralized salt (AB2) include the following compounds.

Polystyrene sulfonates (polystyrenesulfonic acid guanidine salt, polystyrenesulfonic acid DBU salt, polystyrenesulfonic acid DBN salt, etc.), salts of a naphthalenesulfonic acid formaldehyde condensate (naphthalenesulfonic acid formaldehyde condensate guanidine salt, naphthalenesulfonic acid formaldehyde condensate DBU salt, naphthalenesulfonic acid formaldehyde condensate DBN salt, naphthalenesulfonic acid formaldehyde condensate TBD salt, naphthalenesulfonic acid formaldehyde condensate MTBD salt, etc.), salts of an alkyl naphthalenesulfonic acid formaldehyde condensate (methylnaphthalenesulfonic acid formaldehyde condensate guanidine salt, methylnaphthalenesulfonic acid formaldehyde condensate DBU salt, methylnaphthalenesulfonic acid formaldehyde condensate DBN salt, methylnaphthalenesulfonic acid formaldehyde condensate TBD salt, methylnaphthalenesulfonic acid formaldehyde condensate MTBD salt, octylnaphthalenesulfonic acid formaldehyde condensate guanidine salt, octylnaphthalenesulfonic acid formaldehyde condensate DBU salt, octylnaphthalenesulfonic acid formaldehyde condensate DBN salt, octylnaphthalenesulfonic acid formaldehyde condensate TBD salt, octylnaphthalenesulfonic acid formaldehyde condensate MTBD salt, etc.), salts of a naphthalenesulfonic acid-alkylnaphthalene-formaldehyde condensate (naphthalenesulfonic acid-octylnaphthalene-formaldehyde condensate guanidine salt, naphthalenesulfonic acid-octylnaphthalene-formaldehyde condensate DBU salt, naphthalenesulfonic acid-octylnaphthalene-formaldehyde condensate DBN salt, naphthalenesulfonic acid-octylnaphthalene-formaldehyde condensate TBD salt, naphthalenesulfonic acid-octylnaphthalene-formaldehyde condensate MTBD salt, etc.), salts of a hydroxynaphthalenesulfonic acid formaldehyde condensate (hydroxynaphthalenesulfonic acid formaldehyde condensate guanidine salt, hydroxynaphthalenesulfonic acid formaldehyde condensate DBU salt, hydroxynaphthalenesulfonic acid formaldehyde condensate DBN salt, hydroxynaphthalenesulfonic acid formaldehyde condensate TBD salt, hydroxynaphthalenesulfonic acid formaldehyde condensate MTBD salt, etc.), salts of a hydroxynaphthalenesulfonic acid-cresolsulfonic acid-formaldehyde condensate (hydroxynaphthalenesulfonic acid-cresolsulfonic acid-formaldehyde condensate guanidine salt, hydroxynaphthalenesulfonic acid-cresolsulfonic acid-formaldehyde condensate DBU salt, hydroxynaphthalenesulfonic acid-cresolsulfonic acid-formaldehyde condensate DBN salt, hydroxynaphthalenesulfonic acid-cresolsulfonic acid-formaldehyde condensate TBD salt, hydroxynaphthalenesulfonic acid-cresolsulfonic acid-formaldehyde condensate MTBD salt etc.), salts of a melaminesulfonic acid formaldehyde condensate (melaminesulfonic acid formaldehyde condensate guanidine salt, melaminesulfonic acid formaldehyde condensate DBU salt, melaminesulfonic acid formaldehyde condensate DBN salt, melaminesulfonic acid formaldehyde condensate TBD salt, melaminesulfonic acid formaldehyde condensate MTBD salt, etc.), and the like.

Each (AB1) and (AB2) may be used alone or two or more of them may be used as a mixture.

As for the neutralized salt (AB1), the ratio between (Q1) and (Q2) {Q2/(Q1×n)} preferably satisfies the formula (9), more preferably satisfies the formula (10), particularly preferably satisfies the formula (11), and most preferably satisfies the formula (12) in view of lowering the zeta potential and the like.

$$0.01 \leqq \{Q2/(Q1 \times n)\} \leqq 3.0 \quad (9)$$

$$0.1 \leqq \{Q2/(Q1 \times n)\} \leqq 2.5 \quad (10)$$

$$0.2 \leqq \{Q2/(Q1 \times n)\} \leqq 2.3 \quad (11)$$

$$0.5 \leqq \{Q2/(Q1 \times n)\} \leqq 2.2 \quad (12)$$

The weight average molecular weight (Mw) of the neutralized salt (AB2) is preferably 1,000 to 1,000,000, more preferably 2,000 to 500,000, particularly preferably 5,000 to 100,000, most preferably 5,000 to 20,000 in view of the readhesion prevention ability, low foamability, and the like. Additionally, the Mw of the neutralized salt (AB2) is a value obtainable by GPC in the same manner as in the case of the polymers (A2).

The surfactant of the present invention is only required to contain at least one of the neutralized salt (AB1) and (AB2), but in view of the foamability and the like, one containing the neutralized salt (AB2) is preferred.

The neutralized salt (AB1) or (AB2) can be obtained by a neutralization reaction between the acidic compound (A1) or the polymers (A2) and the nitrogen-containing basic compounds (B). For example, it can be obtained by charging an aqueous solution of (A1) and/or (A2) into a reactor which is capable of adjusting temperatures and stirring, adding (B) (where necessary in the form of an aqueous solution) at room temperature (about 25° C.) while stirring, and then uniformly mixing; or by charging (A1) and/or (A2) and (B) at the same time or separately while stirring into a reactor to which water has been already charged, and then uniformly mixing the mixture. The concentration at the time of the neutralization reaction can be appropriately selected according to the purposes.

The surfactant of the present invention has a large dissociation degree of the acid groups (X1) and (X2), thus can efficiently lower the zeta potential of particles and substrates, and also can prevent readhesion of particles, which has been impossible to attain by conventional detergents.

Furthermore, when the surfactant of the present invention is used for cleaning, the zeta potential of the surface of the particle to be removed, depends on the conditions of cleaning (temperature, pH, etc.), and thus it is necessary to be adjusted appropriately. In view of the particle readhesion prevention ability, it is preferably not more than −80 mV, more preferably not more than −90 mV, particularly preferably not more than −100 mV, most preferably not more than −105 mV. Within this range, readhesion of particles occurs more hardly, and also more sufficient performance can be obtained.

The surfactant of the present invention can be used in well-known arbitrary forms such as powder and liquid (a solution, emulsion, suspension). Among these forms, in view of handling property at the time of using, preferred is liquid, more preferred is a solution.

As for the solvent for making these solutions, a water-soluble organic solvent (D) and/or water can be used.

The above water-soluble organic solvent (D) is an organic solvent having the solubility (g/100 g $H_2O$) in water at 20° C. of not less than 3, preferably not less than 10. For example, there may be mentioned sulfoxides {dimethylsulfoxide, sulfolane, 3-methylsulfolane, 2,4-dimethylsulfolane, etc.}; sulfones {dimethylsulfone, diethylsulfone, butylsulfone, bis(2-hydroxyethyl) sulfone, etc.}; amides {N,N-dimethylformamide, N-methylformamide, N,N-dimethylacetoamide, N,N-dimethylpropionamide, etc.}; lactams {N-methyl-2-pyrrolidone, N-ethyl-2-pyrrolidone, N-hydroxymethyl-2-pyrrolidone, etc.}; lactones {β-propiolactone, β-butyrolactone, γ-butyrolactone, γ-valerolactone, δ-valerolactone, etc.}; alcohols {methanol, ethanol, isopropanol, etc.}; glycols and glycol ethers {ethyleneglycol, ethyleneglycolmonomethyl ether, triethyleneglycolmonomethyl ether, ethyleneglycolmonoethyl ether, diethyleneglycol, diethyleneglycolmonomethyl ether, diethyleneglycolmonoethyl ether, diethyleneglycolmonobutyl ether, propyleneglycol, propyleneglycolmonomethyl ether, dipropyleneglycolmonomethylether, 1,3-butyleneglycol, diethylene glycoldimethylether, diethyleneglycoldiethyl ether, triethyleneglycoldimethylo ether, triethyleneglycoldiethyl ether, etc.}; oxazolidinones (N-methyl-2-oxazolidinone, 3,5-dimethyl-2-oxazolidinone, etc.); nitrites (acetonitrile, propionitrile, butyronitrile, acrylonitrile, methacrylonitrile, benzonitrile, etc.); carbonates (ethylenecarbonate, propioncarbonate, etc.); ketones (acetone, diethylketone, acetophenone, methylethylketone, cyclohexanone, cyclopentanone, diacetone alcohol, etc.); cyclic ethers (tetrahydrofuran, tetrahydropyran, etc.), and the like. Moreover, (D) may be used alone, or two or more of them may be used in combination.

As water, there may be mentioned tap water, industrial water, groundwater, distilled water, deionized water, ultrapure water, and the like. Among these, deionized water and ultrapure water are preferred.

When these water-soluble organic solvents (D) are used, the blending amount of (D) (% by weight) is preferably 10 to 90, more preferably 20 to 70, particularly preferably 30 to 50 based on the weight of the surfactant of the invention. Furthermore, when water is used, the blending amount of water (% by weight) is preferably 10 to 90, more preferably 30 to 80, particularly preferably 40 to 70 based on the weight of the surfactant of the invention.

When the salts (AB1) and (AB2) are used in the form of a solution, the concentration of the salts (AB1) and (AB2) in the surfactant of the present invention is preferably about 10 to 50% by weight.

The surfactant of the present invention exhibit surface-active functions (surface tension-reducing function, emulsifying function, low foamability, solubilizing ability, dispersion ability, cleaning ability, and the like) other than the readhesion prevention function. For example, it is suited for uses as a wetting agent, penetrating agent, foaming agent, defoaming agent, emulsifier, dispersant, solubilizing agent, detergent, lubricating agent, antistatic agent, lubricant agent, corrosion inhibitor, level dyeing agent, dye fixing agent, hydrophobizing agent, bactericide, flocculent, and the like, and particularly preferably used as a detergent.

The detergent of the present invention preferably comprises an alkali component (C) in addition to the surfactant of the invention in view of the cleaning properties for particles or grease, and the like.

Examples of the alkali component (C) include (C1) organic alkali represented by the general formula (17), (C2) metal hydroxides, (C3) carbonates, (C4) phosphates, (C5) silicates, (C6) ammonia, (C7) alkanolamines, and a mixture of (C1) to (C7).

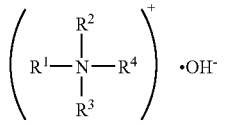

(17)

[In the formula, $R^1$, $R^2$, $R^3$ and $R^4$ each represents a hydrocarbon group containing 1 to 24 carbon atoms, or the group represented by $—(R^5O)_p—H$, $R^5$ represents an alkylene group containing 2 to 4 carbon atoms, and p represents an integer of 1 to 6.]

As the hydrocarbon group containing 1 to 24 carbon atoms, there may be mentioned an alkyl group containing 1 to 24 carbon atoms, alkenyl group containing 2 to 24 carbon atoms, aryl group containing 6 to 24 carbon atoms, and arylalkyl group containing 7 to 24 carbon atoms. These are the same as those exemplified in the above formula (15). As the alkylene group containing 2 to 4 carbon atoms, ethylene, propylene, butylene, and the like are included. Among these, in view of the cleaning properties, ethylene and propylene are preferred. p is preferably 1 to 3.

As specific examples of the organic alkali (C1) represented by the general formula (17), there may be mentioned salts comprising the following cations (1) to (5) and hydroxide anion, and the like.

(1) Tetraalkylammonium cation (carbon atoms of the alkyl: 1 to 6)

Tetramethylammonium, tetraethylammonium, tetra (n- or i-)propylammonium, tetra (n-, i-, or t-)butylammonium, tetrapentylammonium, tetrahexylammonium, trimethylethylammonium, and the like.

(2) Ammonium cations comprising three alkyl groups containing 1 to 6 carbon atoms and one hydrocarbon group containing 7 to 24 carbon atoms Trimethylheptylammonium, trimethyloctylammonium, trimethyldecylammonium, trimethyldodecylammonium, trimethylstearylammonium, trimethylbenzylammonium, triethyloctylammonium, triethylstearylammonium, triethylbenzylammonium, tributylheptylammonium, tributyloctylammonium, trihexylstearylammonium, and the like.

(3) Ammonium cations comprising two alkyl groups containing 1 to 6 carbon atoms and two hydrocarbon groups containing 7 to 24 carbon atoms Dimethyldioctylammonium, diethyldioctylammonium, dimethyldibenzylammonium, and the like.

(4) Ammonium cations comprising one alkyl group containing 1 to 6 carbon atoms and three hydrocarbon groups containing 7 to 24 carbon atoms Methyltrioctylammonium, ethyltrioctylammonium, methyloctyldibenzylammonium, and the like.

(5) Ammonium cations containing an oxyalkylene group (i) Cations containing one oxyalkylene group [hydroxyethyltrimethylammonium, hydroxyethyltriethylammonium, hydroxypropyltrimethyl ammonium, hydroxypropyltriethylammonium, hydroxyethyldimethylethylammonium, hydroxyethyldimethyloctylammonium, etc.];

(ii) cations containing two oxyalkylene groups [dihydroxyethyldimethylammonium, dihydroxyethyldiethylammonium, dihydroxypropyldimethylammonium, dihydroxypropyldiethylammonium, dihydroxyethylmethylethylammonium, dihydroxyethylmethyloctylammonium, bis(2-hydroxyethoxyethyl) octylammonium, etc.];

(iii) cations containing three oxyalkylene groups [trihydroxyethylmethylammonium, trihydroxyethylethylammonium, trihydroxyethylbutylammonium, trihydroxypropylmethylammonium, trihydroxypropylethylammonium, trihydroxyethyloctylammonium, etc.], As the metal hydroxides (C2), there may be mentioned alkali metal hydroxides (lithium hydroxide, sodium hydroxide, potassium hydroxide, etc.), alkaline earth metal hydroxides (calcium hydroxide, magnesium hydroxide, barium hydroxide, etc.), and the like.

As the carbonates (C3), there may be mentioned alkali metal salts (sodium carbonate, potassium carbonate, etc.), alkaline earth metal salts (calcium carbonate, magnesium carbonate, barium carbonate, etc.), and the like.

As the phosphates (C4), there may be mentioned alkali metal salts (sodium pyrophosphate, potassium pyrophosphate, sodium tripolyphosphate, potassium tripolyphosphate, etc.), alkaline earth metal salts (calcium pyrophosphate, magnesium pyrophosphate, barium pyrophosphate, calcium tripolyphosphate, magnesium tripolyphosphate, barium tripolyphosphate, etc.), and the like.

As the silicates (C5), there may be mentioned alkali metal salts (sodium silicate, potassium silicate, etc.), alkaline earth metal salts (calcium silicate, magnesium silicate, barium silicate, etc.), and the like.

As the alkanolamines (C7), there may be mentioned monoethanolamine, diethanolamine, triethanolamine, N-methyldiethanolamine, N,N-dimethylethanolamine and an EO adduct of ethylenediamine (addition number of moles 1 to 7), and the like.

Among the alkali components (C), in view of the cleaning properties, preferred are organic alkali (C1) represented by the general formula (17) and metal hydroxides (C2), and more preferred are (C1) since there is no possibility that alkali metals or alkaline earth metals remain after cleaning. In view of the cleaning properties, rinsing ability, and the like, preferred are (1) tetraalkylammonium cations, (2) ammonium cations comprising three alkyl groups comprising 1 to 6 carbon atoms and one hydrocarbon group containing 7 to 24 carbon atoms, (3) ammonium cations comprising two alkyl groups containing 1 to 6 carbon atoms and two hydrocarbon groups containing 7 to 24 carbon atoms, and (4) ammonium cations comprising one alkyl group containing 1 to 6 carbon atoms and three hydrocarbon groups containing 7 to 24 carbon atoms, more preferred are (1) and (2), particularly preferred is (1), most preferred is a hydroxide anionic salt of tetramethylammonium cations or tetraethylammonium cations, or combinational use of these.

When the alkali components (C) are used, in view of the cleaning properties and the like, the content of (C) (% by weight) is preferably 0.1 to 10, more preferably 0.3 to 8, particularly preferably 0.5 to 5, based on the weight of the detergent of the present invention.

Moreover, the detergent of the present invention can be used in arbitrary forms as the surfactant of the invention. Among those forms, in view of handling ability at the time of using, and the like, preferred is liquid, more preferred is a solution.

In addition, when making the detergent into a solution, the detergent of the present invention may contain the above-mentioned water-soluble organic solvent (D) and/or water, where necessary.

Among the water-soluble organic solvents (D), in view of the cleaning properties and the like, glycols and glycol ethers are preferred, and ethylene glycols, ethylene glycol monomethyl ethers, diethyleneglycolmonomethyl ethers, diethylene glycols, and propylene glycols are more preferred.

When these water-soluble organic solvents (D) are used, the blending amount of (D) (% by weight) is preferably 10 to 90, more preferably 30 to 80, particularly preferably 40 to 70 based on the weight of the detergent of the present invention.

When water is used, the blending amount thereof is preferably 10 to 90, more preferably 20 to 85, particularly preferably 30 to 80 based on the weight of the detergent of the invention. Additionally, when the detergent of the present invention contains water, most parts of the neutralized salt (AB1) or (AB2) are dissociated into the acidic compound (A1) and compound (B), or the polymer (A2) and compound (B) in water, and occur as ions.

The concentration of the salt (AB1) and/or (AB2) in the detergent can be appropriately adjusted according to the purpose, but is preferably about 0.01 to 20% weight.

When the water-soluble organic solvents (D) and water are used, the weight ratio between (D) and water {(D)/water} contained in the detergent is preferably 20/80 to 90/10, more preferably 30/70 to 80/20, particularly preferably 40/60 to 70/30 in view of the cleaning properties for particles and grease, and the like.

Furthermore, polyhydric alcohols (E) having 3 to 2,000 valences may be added to the detergent of the present invention in view of preventing metal corrosion in cleaning electric components to which metals (aluminum wiring, etc.) are provided, and the like.

As polyhydric alcohols (E), there may be mentioned (E1) aliphatic polyhydric alcohols (glycerin, trimethylolethane, trimethylolpropane, pentaerythritol, etc.,), (E2) dehydrated condensates of (E1) (diglycerin, triglycerin, tetraglycerin, pentaglycerin, etc.); (E3) sugars [(E3-1) monosaccharides {pentose (arabinose, xylose, ribose, xylulose, ribulose, etc.), hexoses (glucose, mannose, galactose, fructose, sorbose, tagatose, etc.), heptoses (sedoheptulose, etc.), etc.}, (E3-2) disaccharides {trehalose, saccharose, maltose, cellobiose, gentiobiose, lactose, etc.}, (E3-3) trisaccharides (raffinose, maltotriose, etc.), etc.]; (E4) polysaccharides comprising the above monosaccharides and derivatives thereof {e.g. cellulose compounds (methyl cellulose, ethyl cellulose, hydroxyethyl cellulose, ethylhydroxyethyl cellulose, hydroxypropyl cellulose, saponification products of these, etc.)}, gelatin, starch, dextrin, chitin, chitosan, etc.}; (E5) sugar alcohols (arabitol, adonitol, xylitol, sorbitol, mannitol, dulcitol, etc.): (E6) tris-phenols (tris-phenol PA, etc.); (E7) novolac resins (Mw: 1,000 to 100,000) (phenol novolac, cresol novolac, etc.): (E8) polyphenols; (E9) other hydroxyl group-containing polymers (Mw: 1,000 to 1,000,000) [polyvinyl alcohols, acrylic polyols {polyhydroxyethyl(meth)acrylate, a copolymerization product obtainable from hydroxyethyl(meth) acrylate and other vinyl monomer, etc.}, etc.], alkylene oxide (carbon atoms 2 to 4) adducts (addition number of moles 1 to 7 moles) of these, and the like. In addition, the polyhydric alcohols (E) may be used alone, or two or more of them may be used in combination.

Among these polyhydric alcohols (E), in view of having high metal corrosion prevention effect, preferred are (E1), (E2), (E3) and (E5), more preferred are glycerin, saccharose and sorbitol.

When the polyhydric alcohols (E) are used, the blending amount of (E) (% by weight) is preferably 1 to 20, more preferably 2 to 10, particularly preferably 3 to 7 based on the weight of the detergent of the invention.

Moreover, the polyhydric alcohols (E) exhibit particularly excellent metal corrosion prevention effect when they are added to the detergent of the present invention containing the alkali component (C) and water. In this case, the blending amount of (C) relative to the total weight of (C) and water (% by weight) is preferably 0.1 to 50, more preferably 0.5 to 40, particularly preferably 1 to 35 in view of the cleaning properties and the like. Additionally, the blending amount of (E) (% by weight) relative to the total weight of (C) and (E) is preferably 10 to 90, more preferably 20 to 80, particularly preferably 30 to 75 in view of preventing metal corrosion, and the like.

The detergent of the present invention contains at least one surfactant of the invention, and a conventional dispersant, and/or a surfactant other than the surfactant of the present invention may be used in combination within the range that the effect of the present invention is not adversely affected.

As specific examples of the conventional dispersant, there may be mentioned ammonium salts, alkylamine salts (dimethylamine, diethylamine, triethylamine, etc.) and alkanolamine salts (triethanolamine salts, etc.) of the polymers (A2) exemplified above; polysaccharides (hydroxyethyl cellulose, cationized cellulose, hydroxymethyl cellulose, hydroxypropyl cellulose, guar gum, cationized guar gum, xanthan gum, alginic acid salt, cationized starch, etc.), polyvinyl alcohols, condensed phosphoric acids (metaphosphoric acid, pyrophosphate, etc.), phosphates {phytic acid, di(polyoxyethylene) alkyl ether phosphoric acid, tri(polyoxyethylene) alkyl ether phosphoric acid, etc.}, mixtures of these, and the like.

When these dispersants are used, the blending amount of these dispersants (% by weight) is preferably 0.0001 to 10 based on the weight of the detergent of the invention.

As surfactants other than the surfactant of the present invention, any of nonionic, anionic, cationic or amphoteric one, and a mixture of these may be used, and preferred are nonionic or anionic surfactants.

As the nonionic surfactants, there may be mentioned ether type surfactants such as alkyl ether type, alkylallyl ether type, and alkylthio ether type ones; ester type surfactants such as alkylester type and sorbitan alkylester type ones; condensation type surfactants with an amine such as polyoxyalkylenealkyl amine; condensation type surfactants with an amide such as polyoxyalkylenealkyl amide; pluronic or tetronic type surfactants prepared by a random or block condensation of polyoxyethylene and polyoxypropylene; polyethyleneimine type surfactants, and the like.

As the alkyl ether type nonionic surfactants, there may be mentioned alkylene oxide adducts of straight chain or branched chain primary alcohols containing 8 to 24 carbon atoms.

As the primary alcohols, there may be mentioned n-octyl alcohol, 2-ethylhexyl alcohol, n-decyl alcohol, isodecyl alcohol, n-dodecyl alcohol (lauryl alcohol), isododecyl alcohol, n-tridecyl alcohol, isotridecyl alcohol, n-tetradecyl alcohol, n-hexadecyl alcohol, n-octadecyl alcohol, and the like.

As the alkylene oxides, there may be mentioned ethylene oxides, propylene oxides, and combinations of these, and the addition mole number is 1 to 50 moles, preferably 2 to 20 moles.

As specific examples of the alkyl ether type nonionic surfactants, there may be mentioned ethylene oxide (7 moles) adducts of isodecyl alcohol, ethylene oxide (8 moles) adducts of n-dodecyl alcohol, and the like.

As the alkylaryl ether type nonionic surfactants, there may be mentioned ethylene oxide adducts of octylphenol, ethylene oxide adducts of nonylphenol, and the like.

As the polyoxyalkylenealkyl amines among condensation type nonionic surfactants with an amine, there may be mentioned alkylene oxide adducts of primary or secondary alkyl amines containing 8 to 36 carbon atoms.

As the alkyl amines, there may be mentioned n-octyl amine, n-decyl amine, isodecyl amine, n-dodecyl amine (lauryl amine), isododecyl amine, n-tetradecyl amine, di n-octyl amine, di n-decyl amine, and the like.

As the alkylene oxides, there may be mentioned the same ones as above, and preferable addition mole number is also the same as above.

As specific examples of the polyoxyalkylenealkyl amines, there may be mentioned ethylene oxide (7 moles) adducts of lauryl amine, ethylene oxide (9 moles) adducts of n-tetradecyl amine, and the like.

As the anionic surfactants, there may be mentioned sulfonic acid surfactants, sulfate surfactants, phosphate surfactants, fatty acid surfactants, polycarboxylic acid surfactants, and the like.

As the anionic surfactants, there may be mentioned neutralized salts constituted of the acidic compound (A1) and/or polymer (A2) and the basic compound mentioned below.

As the basic compounds, there may be mentioned alkali metals (sodium, potassium, lithium, etc.) orhydroxides thereof, alkaline earth metals (calcium, magnesium, etc.) or hydroxides thereof, ammonia, diethylamine, butylamines (n-butylamine, isobutylamine, etc.), alkanolamines (monoethanol amine, diethanolamine, triethanolamine, etc.), piperidine, aniline, pyridine, morpholine, etc.

As the cationic surfactants, there may be mentioned amine surfactants and quaternary ammonium salt surfactants.

As the amphoteric surfactants, there may be mentioned amino acid surfactants, betaine surfactants, and the like.

When these surfactants are used, the blending amount of these surfactants (% by weight) is preferably 0.0001 to 10 based on the weight of the detergent of the invention.

To the detergent of the present invention, one or more other additives (an antioxidant, chelating agent, corrosion inhibitor, pH adjuster, buffering agent, defoaming agent, reducing agent, hydrotrope, etc.) may be added within the range that the effect of the present invention is not adversely affected.

As specific examples of the antioxidant, there may be mentioned phenol antioxidants {2,6-di-t-butylphenol, 2-t-butyl-4-methoxyphenol, 2,4-dimethyl-6-t-butylphenol, etc.}; amine antioxidants {monoalkyldiphenylamines such as monooctyldiphenylamine and mononononyldiphenylamine; dialkyldiphenylamines such as 4,4'-dibutyldiphenylamine and 4,4'-dipentyldiphenylamine; polyalkyldiphenylamines such as tetrabutyldiphenylamine and tetrahexyldiphenylamine; naphthylamines such as α-naphthylamine and phenyl-α-naphthylamine, etc.}; sulfur compounds {phenothiazine, pentaerythritol-tetrakis-(3-laurylthiopropionate), bis(3,5-tert-butyl-4-hydroxybenzyl)sulfide, etc.}; phosphoric antioxidants {bis(2,4-di-t-butylphenyl) pentaerythritol-diphosphite, phenyldiisodecylphosphite, diphenyldiisooctylphosphite, triphenylphosphite}, etc.; and the like.

These may be used in combination of one or two or more species. When these antioxidants are used, the blending amount of these (% by weight) is preferably 0.001 to 10 based on the weight of the detergent of the invention.

As specific examples of the chelating agent, there may be mentioned aminopolycarboxylic acid salts {ethylenediaminetetraacetate (EDTA), diethylenetriaminepentaacetate (DTPA), triethylenetetraminehexaacetate (TTHA), hydroxyethylethylenediaminetriacetate (HEDTA), dihydroxyethylethylenediaminetetraacetate (DHEDDA), nitrilo triacetate (NTA), hydroxyethyliminodiacetate (HIDA), β-alanine diacetate, aspartic acid diacetate, methylglycine diacetate, iminodisuccinate, serine diacetate, hydroxyiminodisuccinate, dihydroxyethylglycine salt, aspartate, glutamate, etc.}; hydroxy carboxylates (hydroxy acetate, tartrate, citrate, glucorate, etc.); cyclocarboxylates (pyromellitic acid salt, benzopolycarboxylic acid salt, cyclopentane tetracarboxylate, etc.); ether carboxylates (carboxymethyl tartronate, carboxymethyloxy succinate, oxydisuccinate, tartaric acid monosuccinate, tartaric acid disuccinate, etc.); other carboxylates (maleic acidderivatives, oxalates, etc.); organic carboxylic acid (salt) polymers {acrylic polymers and copolymers (acrylic acid-allyl alcohol copolymer, acrylic acid-maleic acid copolymer, hydroxyacrylic acid polymer, polysaccharides (mentioned above)-acrylic acid copolymer, etc.); polyvalent carboxylic acid polymers and copolymers (polymers and copolymers of monomers such as maleic acid, itaconic acid, fumaric acid, tetramethylene-1,2-dicarboxylic acid, succinic acid, aspartic acid and glutamic acid), glyoxylic acid polymers, polysaccharides (starch, cellulose, amylose, pectin, carboxymethyl cellulose, etc.); phosphonic acid salts {methyl diphosphonic acid salt, aminotrismethylene phosphonic acid salt, ethylidene diphosphonic acid salt, 1-hydroxyethylidene-1,1-diphosphonic acid salt, ethylaminobismethylene phosphonic acid salt, ethylenediaminebismethylene phosphonic acid salt, ethylenediaminetetramethylene phosphonic acid salt, hexamethylenediaminetetramethylene phosphonic acid salt, propylenediaminetetramethylene phosphonic acid salt, diethylenetriaminepentamethylene phosphonic acid salt, triethylenetetraminehexamethylene phosphonic acid salt, triaminotriethylaminehexamethylene phosphonic acid salt, trans-1,2-cyclohexanediaminetetramethylene phosphonic acid salt, glycol ether diaminetetramethylene phosphonic acid salt, tetraethylenepentamineheptamethylene phosphonic acid salt, etc.}, and the like.

In addition, as these salts, there may be mentioned alkali metal (lithium, sodium, potassium, etc.) salts, ammonium salts, alkanolamine (monoethanolamine, triethanolamine, etc.) salts, and the like.

These may be used in combination of one or two or more species. When these chelating agents are used, the blending amount thereof (% by weight) is preferably 0.0001 to 10 based on the weight of the detergent of the invention.

As specific examples of the corrosion inhibitor, there may be mentioned nitrogen-containing organic corrosion inhibitors such as benzotriazole, tolyltriazole, benzotriazole having a hydrocarbon group containing 2 to 10 carbon atoms, benzoimidazole, imidazole having a hydrocarbon group containing 2 to 20 carbon atoms, thiazole having a hydrocarbon group containing 2 to 20 carbon atoms, and 2-mercaptobenzothiazole; alkyl or alkenyl succinic acids such as a half ester of dodecenyl succinic acid, octadecenylsuccinic anhydride and dodecenylsuccinic acid amide; partial esters of polyhydric alcohols such as sorbitan monooleate, glycerin monooleate, pentaerythritol monooleate; and the like. These may be used in combination of one or two or more species.

When these corrosion inhibitors are used, the blending amount of these (% by weight) is preferably 0.01 to 10 based on the weight of the detergent of the invention.

As specific examples of the pH adjuster, there may be mentioned mineral acids such as hydrochloric acid, sulfuric acid and nitric acid and alkanolamines such as monoethanol amine and triethanol amine, and water-soluble amines such as ammonia. Those containing substantially no impurities such as a metal ion are preferred, and these may be used in combination of one or two or more species.

When these pH adjusters are used, the blending amount thereof (% by weight) is preferably 0.001 to 10 based on the weight of the detergent of the invention.

As specific examples of the buffering agent, organic acids or inorganic acids having a buffering function and/or salts of these can be used. As the organic acids, there may be mentioned acetic acid, formic acid, gluconic acid, glycolic acid, tartaric acid, fumaric acid, levulinic acid, valeric acid, maleic acid, mandelic acid, and the like. As the inorganic acids, there may be mentioned, for example, phosphoric acid, boric acid, and the like. Moreover, as the salts of these acids, there may be mentioned ammonium salts and alkanol amine salts such as triethanolamine salt. These may be used in combination of one or two or more species.

When these buffering agents are used, the blending amount thereof (% by weight) is preferably 0.1 to 10 based on the weight of the detergent of the invention.

As specific examples of the defoaming agent, there may be mentioned silicone defoaming agents {defoaming agents containing dimethylsilicone, fluorosilicone, polyether silicone, etc. as a constituent}, and the like.

When these defoaming agents are used, the blending amount thereof (% by weight) is preferably 0.0001 to 1 based on the weight of the detergent of the invention.

As the reducing agent, there may be mentioned sulfite salts (e.g. sodium sulfite, ammonium sulfite, etc.), thiosulfates (e.g. sodium thiosulfite, ammonium thiosulfite, etc.), aldehydes (e.g. formaldehyde, acetaldehyde, etc.), phosphorus reducing agents (e.g. tris-2-carboxyethyl phosphine, etc.), other organic reducing agents (e.g. formic acid, oxalic acid, succinic acid, lactic acid, malic acid, butyric acid, pyruvic acid, citric acid, 1,4-naphthoquinone-2-sulfonic acid, ascorbic acid, isoascorbic acid, gallic acid, hydroxylamine, diethylhydroxylamine, etc.), derivatives of those, and the like.

These may be used in combination of one or two or more species. When these reducing agents are used, the blending amount thereof (% by weight) is preferably 0.1 to 10 based on the weight of the detergent of the invention.

As the hydrotrope, there may be mentioned toluenesulfonic acid, xylenesulfonic acid, cumenesulfonic acid, salts of these acids, and the like. As the salts of these acids, there may be mentioned alkanol amine salts such as ammonium salt and triethanolamine salt, and the like. These may be used in combination of one or two or more species.

When these hydrotropes are used, the blending amount thereof (% by weight) is preferably 0.1 to 10 based on the weight of the detergent of the invention.

The surface tension (25° C.) (dyn/cm) of the detergent of the present invention is preferably 10 to 65, more preferably 12 to 50, particularly preferably 15 to 40.

The surface tension can be measured according to the ring method of JIS K 3362: 1998, corresponding to ISO 304.

The total content (% by weight) of alkali metals (lithium, sodium, potassium) or alkaline earth metals (magnesium, calcium, strontium, barium) in the detergent of the invention is preferably 0.0000001 to 0.1, more preferably 0.000001 to 0.01, particularly preferably 0.00001 to 0.001 based on the weight of the detergent. As the detergent of the present invention, those containing completely no alkali metal or alkaline earth metal are preferred, and in view of producibility and the like, the above ranges are preferred.

As the method for determining the alkali metals and alkaline earth metals, a well-known method, for example, an atomic absorption method, ICP method, and ICP mass spectrometry can be used, but in view of the analysis precision, the ICP mass spectrometry is preferred.

The applications of the detergent of the invention are not particularly restricted, but it is particularly preferably used as a detergent in cleaning processes during manufacturing processes of various electronic materials, electronic components, etc., such as semiconductor elements, silicon wafers, color filters, substrates for electronic devices (flat panel displays such as liquid crystal panels, plasma and organic EL, light and magnetic disks, CCD), optical lens, printed circuit boards, cables for optical communications, and LED. Among these, it is particularly preferably used in producing substrates for liquid crystal panels or semiconductor elements.

Moreover, as an object to be cleaned (stain) of the detergent of the present invention, there may be mentioned organic substances such as oil, fingerprints, resins and organic particles, and inorganic substances such as inorganic particles (glass powders, abrasive grains, ceramic powders, metal powders, etc.).

As the method of cleaning electronic materials and electronic components using the detergent of the present invention, ultrasonic cleaning, shower cleaning, spray cleaning, brush cleaning, dip cleaning, dip oscillating cleaning, single wafer processing cleaning, and combination of these methods can be used. In particular, by combinedly using the ultrasonic cleaning method, the cleaning effect can be further exhibited.

The detergent of the present invention can be optionally used after further dilution with water. As the water to be used in that occasion, those water exemplified above may be used, but preferred are deionized water and ultrapure water.

Particularly, when the detergent of the present invention is used in cleaning processes of electronic materials, electronic components, and the like, the detergent of the present invention is preferably diluted with deionized water or ultrapure water so as to have the concentration of the surfactant of the invention in 1 to 500 ppm.

In addition, when the detergent of the present invention is used after dilution with water, most parts of the neutralized salt (AB1) or (AB2) are dissociated into the acidic compound (A1) and compound (B), or the polymer (A2) and compound (B) in water, and occur as ions.

When the detergent of the present invention is used as a concentrate liquid or diluted with water, the pH thereof is preferably 1 to 12, more preferably 2 to 11, particularly preferably 4 to 8 although it depends on the neutralization ratio in neutralizing the acidic compound (A1) and/or polymer (A2) with the compound (B), or the species and amount of the additives to be used. The surfactant of the present invention has excellent zeta potential lowering ability even in the neutral range, and thus can exhibit particularly excellent effect even in applications for cleaning of electric components and the like in the neutral range, which are concerned to cause metal corrosion.

Since the surfactant of the present invention can lower the zeta potential of particle surfaces effectively, readhesion of particles to substrates in a cleaning process, which has been a conventional subject, can be effectively prevented. Furthermore, since it substantially contains no alkali metal, there is no remaining alkali metal on the substrate surfaces after cleaning, the reliability and yield of the device can be improved.

BEST MODES FOR CARRYING OUT THE INVENTION

Hereinafter, the present invention will be described in further detail by means of examples. However, the present invention is not limited to these examples. Unless otherwise specified, "%" represents "% by weight" and "parts" represents "parts by weight". In addition, the differences of heat of formation (Q1) and (Q2) were calculated by using "CAChe Worksystem 6.01" manufactured by FUJITSU, LTD. That is, (Q1) and (Q2) were determined by optimizing the structure with "MM2 geometry", which is a molecular force field method, calculating $\Delta_f H^o_{H+B}$, $\Delta_f H^o_{B}$, $\Delta_f H^o_{HX}$, and $\Delta_f H^o_{x-}$ by "PM3 geometry", which is a semiempirical molecular orbital method, and then calculating (Q1) and (Q2) according to the above formulas.

EXAMPLES 1 and 2

Into a column filled with a cation exchange resin "Amberlite IR-120B" (manufactured by Organo Corporation) in a chromatograph tube having the diameter of 3 cm and length of 50 cm and being allowed to stand perpendicularly, at 25° C., 105 parts of an aqueous solution of a naphthalenesulfonic acid formalin condensate sodium salt "Demol NL" (manufactured by Kao Corporation) adjusted to have 10% solid content were gradually added from the above of the column in small amounts. An eluent once put through the ion exchange resin was put through it again from the above of the column. This operation was repeatedly carried out until the sodium content of the eluent determined using ICP (ICPS-8000, manufactured by Shimadzu Corporation) became less than 1 ppm, and 100 parts of a 9% aqueous solution of the naphthalenesulfonic acid formalin condensate was obtained.

Next, into a reactor which is capable of adjusting temperatures and equipped with a stirring device, 100 parts of the 9% aqueous solution of the naphthalenesulfonic acid formalin condensate obtained were charged. The mixture was gradually added with 6.2 parts of DBU (manufactured by San-Apro Ltd.: a registered trademark of the company) while adjusting the temperature at 25° C. and stirring, and stirring was continued for 10 minutes. Then, 106 parts of the surfactant of the present invention comprising a 14% aqueous solution of the naphthalenesulfonic acid formalin condensate DBU salt (S1) (pH=6.5 at 25° C.) were obtained. In addition, the weight average molecular weight of (S1) was 5000.

EXAMPLE 3

A 9% aqueous solution of the naphthalenesulfonic acid formalin condensate was obtained in the same manner as in Example 1. Into a reactor which is capable of adjusting temperatures and equipped with a stirring device, 100 parts of the 9% aqueous solution of the naphthalenesulfonic acid formalin condensate were charged, 3.7 parts of guanidine carbonate (manufactured by Wako Pure Chemicals Industries, Ltd.) were added and the mixture was heated and stirred at 50° C. for 10 minutes. Then, 103 parts of the surfactant of the present invention comprising an 11% aqueous solution of the naphthalenesulfonic acid formalin condensate guanidine salt (S2) (pH=6.4 at 25° C.) were obtained. In addition, the weight average molecular weight of (S2) was 5000.

EXAMPLE 4

100 parts of a 9% aqueous solution of the polystyrenesulfonic acid were obtained in the same manner as in Example 1 except that a polystyrenesulfonic acid sodium salt "POLITY PS-1900" (manufactured by Lion Corporation) was used instead of a naphthalenesulfonic acid formalin condensate sodium salt. Into a reactor which is capable of adjusting temperatures and equipped with a stirring device, 100 parts of the 9% aqueous solution of polystyrenesulfonic acid were charged, 7.4 parts of DBU were added and the mixture was stirred at 25° C. for 10 minutes. Then, 107 parts of the surfactant of the present invention comprising a 15% aqueous solution of the polystyrenesulfonic acid DBU salt (S3) were obtained (pH=6.5 at 25° C.). In addition, the weight average molecular weight of (S3) was 14000.

EXAMPLE 5

21 parts of naphthalenesulfonic acid and 10 parts of ultrapure water were charged into a reactor with stirrer, and 8 parts of 37% formaldehyde were added dropwise at 80° C. for 3 hours. After completion of the dropwise addition, the mixture was heated to 105° C. and subjected to reaction for 25 hours, and the mixture was cooled to room temperature (about 25° C.). In a water bath, while adjusting the temperature at 25° C., DBU was gradually added to the mixture, and the pH was adjusted to 6.5 (about 15 parts of DBU was used). After adjusting the solid content to 40% by adding ultrapure water, 100 parts of the surfactant of the present invention comprising an aqueous solution of the salt (S4) were obtained. In addition, the weight average molecular weight of (S4) was 5000.

EXAMPLE 6

100 parts of 1,2-dichloroethane were charged into a reactor equipped with a stirrer and capable of adjusting temperatures and refluxing, and under stirring, the content was heated to 90° C. after nitrogen substitution. Then, ethylene dichloride was subjected to refluxing. 120 parts of styrene and an initiator solution prepared by dissolving 1.7 parts of 2,2'-azobis isobutyronitrile in 20 parts of ethylene dichloride in advance were separately added dropwise into the reactor for 6 hours. After completion of dropwise addition, polymerization was further carried out for 1 hour. After completion of polymerization, the mixture was cooled to 20° C. under nitrogen seal, and while controlling the temperature at 20° C., 105 parts of anhydrous sulfate was added dropwise for 10 hours. After completion of dropwise addition, the mixture was further subjected to sulfonation reaction for 3 hours. After the sulfonation, 500 parts of ultrapure water were added, and under stirring, the mixture was gradually added with 167 parts of DBU while adjusting the temperature at 20° C. in a water bath. After filtration, the solvent was completely distilled off by using an evaporator at 40° C. and 1.33 kPa, and adjusting the solid content to 40% by further adding ultrapure water, 900 parts of the surfactant of the present invention comprising an aqueous solution of the salt (S5) were obtained. In addition, the weight average molecular weight of (S5), sulfonation ratio of (S5) and the pH of this surfactant were 40,000, 97%, and 6.5, respectively.

EXAMPLE 7

100 parts of the surfactant of the present invention comprising an aqueous solution of the salt (S6), which was adjusted to have a solid content of 40%, were obtained in the same manner as in Example 5 except that DBN (manufactured by San-Apro Ltd.) was used instead of DBU. In addition, the weight average molecular weight of (S6) was 5000.

EXAMPLE 8

100 parts of the surfactant of the present invention comprising an aqueous solution of the salt (S7), which was adjusted to have the solid content of 40%, were obtained in the same manner as in Example 5 except that TBD (manufactured by Aldrich Corporation) was used instead of DBU. In addition, the weight average molecular weight of (S7) was 5000.

EXAMPLE 9

100 parts of the surfactant of the present invention comprising an aqueous solution of the salt (S8), which was adjusted to have the solid content of 40%, were obtained in the same manner as in Example 5 except that MTBD (manufactured by Aldrich Corporation) was used instead of DBU. In addition, the weight average molecular weight of (S8) was 5000.

EXAMPLE 10

100 parts of the surfactant of the present invention comprising an aqueous solution of the salt (S9), which was adjusted to have the solid content of 40%, were obtained in the same manner as in Example 6 except that DBN was used instead of DBU. In addition, the weight average molecular weight of (S9) was 40000.

EXAMPLE 11

100 parts of the surfactant of the present invention comprising an aqueous solution of the salt (S10), which was adjusted to have the solid content of 40%, were obtained in the same manner as in Example 6 except that guanidine carbonate was used instead of DBU. In addition, the weight average molecular weight of (S10) was 40000.

EXAMPLES 12 and 13

Into a reactor which is capable of adjusting temperatures and equipped with a stirring device, 100 parts of a 10% aqueous solution of dodecylbenzenesulfonic acid (manufactured by Tokyo Kasei Kogyo Co., Ltd., HLB: 7.4) were charged, and while the mixture was adjusted at 25° C. and stirred, 4.7 parts of DBU was slowly added. Stirring was continued for 10 minutes, and then 105 parts of the surfactant of the present invention comprising a 14% aqueous solution of the dodecylbenzenesulfonic acid DBU salt (S11) (pH=6.5 at 25° C.) were obtained.

EXAMPLE 14

Into a reactor equipped with a stirring device, 100 parts of a 1.6% aqueous solution of dodecylbenzenesulfonic acid were charged, and dissolved while heated and stirred at 50° C. for 5 minutes. Then, 0.44 part of guanidine carbonate was slowly added in small amounts while heating and stirring at 50° C. Heating and stirring were continued for about 15 minutes until the generation of carbon dioxide stopped in order to obtain 100 parts of the surfactant of the present invention comprising a 1.9% aqueous solution of the dodecylbenzenesulfonic acid guanidine salt (S12) (pH=6.5 at 25° C.).

EXAMPLE 15

212 parts of the surfactant of the present invention comprising a 10% aqueous solution of the dodecylbenzenesulfonic acid phosphazene salt (S13) were obtained in the same manner as in Example 12 except that 112 parts of a 10% aqueous solution of $Et[N{=}P(dma)_2]_2N(CH_3)_2$ (manufactured by Fluka Corporation) were used instead of DBU (pH=6.8 at 25° C.).

EXAMPLE 16

30 parts of isopropyl alcohol and 10 parts of ultrapure water were charged into a reactor equipped with a stirrer and capable of adjusting temperatures and refluxing, and the content was heated to 75° C. after nitrogen substitution. 41 parts of a 75% aqueous solution of acrylic acid and 9.5 parts of a 15% solution of dimethyl 2,2'-azobisisobutylate in isopropyl alcohol were separately added dropwise into the reactor for 3.5 hours under stirring (each dropwise addition of these was started at the same time). After completion of dropwise addition, stirring was carried out at 75° C. for 5 hour, then ultrapure water was periodically added in order to ensure the system will not harden, and then a mixture of water and isopropyl alcohol was distilled off until trace of isopropyl alcohol could not be detected. The aqueous solution of polyacrylic acid obtained was neutralized to pH 7 by addition of DBU (about 45 parts), and then concentration of the solution was adjusted to 40% with ultrapure water in order to obtain 180 parts of the surfactant of the present invention comprising an aqueous solution of the polyacrylic acid DBU salt (S14). In addition, the weight average molecular weight of (S14) was 10000, and pH of the surfactant was 7.0.

EXAMPLE 17

120 parts of the surfactant of the present invention comprising a 40% aqueous solution of the polyacrylic acid DBU salt (S15) were obtained by polymerization and neutralization in the same manner as in Example 16 except that 350 parts of isopropyl alcohol as a polymerization solvent, 120 parts of ultrapure water, 40 parts of a 50% aqueous solution of acrylic acid as a monomer, and 13 parts of a 5% solution of 4,4'-azobis(4-cyanovaleric acid) in isopropyl alcohol as an initiator were used. In addition, the weight average molecular weight of (S15) was 5000, and pH of the surfactant was 7.0.

EXAMPLE 18

350 parts of the surfactant of the present invention comprising a 40% aqueous solution of the polyacrylic acid DBU salt (S16) were obtained by polymerization and neutralization in the same manner as in Example 16 except that 125 parts of isopropyl alcohol as a polymerization solvent, 62 parts of ultrapure water, 80 parts of a 75% aqueous solution of acrylic acid as a monomer, and 9.5 parts of a 20% solution of 4,4'-azobis(4-cyanovaleric acid) in isopropyl alcohol as an initiator were used. In addition, the weight average molecular weight of (S16) was 20000, and pH of the surfactant was 7.0.

EXAMPLE 19

140 parts of the surfactant of the present invention comprising a 40% aqueous solution of the 2-acryloylamino-2,2'-dimethylethanesulfonic acid/acrylic acid copolymer DBU salt (S17) were obtained by polymerization and neutralization in the same manner as in Example 16 except that 44 parts of a 70% aqueous monomer solution comprising 23 parts of 2-acryloylamino-2,2'-dimethylethanesulfonic acid, 8 parts of acrylic acid, and 13 parts of ultrapure water were used as a monomer. In addition, the weight average molecular weight of (S17) was 8000, and pH of the surfactant was 7.0.

EXAMPLE 20

A sodium methacryloyloxypolyoxyalkylene sulfate/acrylic acid copolymer was obtained by polymerization and neutralization in the same manner as in Example 16 except that 47 parts of a 65% aqueous monomer solution comprising 32 parts of a 50% aqueous solution of sodium methacryloyloxypolyoxyalkylene sulfate (manufactured by Sanyo Chemical Industries, Ltd., ELEMINOL RS-30) and 15 parts of acrylic acid as a monomer. The copolymer obtained was diluted to have the solid content of 10% by adding ultrapure water, and then sodium ions were removed so that the sodium ion concentration in the solution being not higher than 1 ppm in the same manner as in Example 1. The temperature of the methacryloyloxypolyoxyalkylene sulfate/acrylic acid copolymer obtained was adjusted to 25° C., neutralization to pH 7 was carried out by addition of DBU (about 24 parts), and then concentration adjustment of the solution was carried out by adding ultrapure water in order to obtain 500 parts of the surfactant of the present invention comprising a 10% aqueous solution of the methacryloyloxypolyoxyalkylene sulfate/acrylic acid copolymer DBU salt (S18). In addition, the weight average molecular weight of (S18) was 9000, and pH of the surfactant was 7.0.

COMPARATIVE EXAMPLES 1 and 2

A 9% aqueous solution of the naphthalenesulfonic acid formalin condensate was obtained in the same manner as in Example 1, and into a reactor which is capable of adjusting temperatures and equipped with a stirring device, 100 parts of the 9% aqueous solution of the naphthalenesulfonic acid formalin condensate were charged. Then, 6.9 parts of aqueous ammonia (10%) (manufactured by Wako Pure Chemical Industries, Ltd.) were added and the mixture was heated and stirred at 50° C. for 10 minutes to obtain 102 parts of a surfactant comprising a 9% aqueous solution of the naphthalenesulfonic acid formalin condensate ammonium salt (T1) for comparison (pH=5.2 at 25° C.).

COMPARATIVE EXAMPLE 3

100 parts of a 9% aqueous solution of polystyrenesulfonic acid were obtained in the same manner as in Example 4. Then, into a reactor which is capable of adjusting temperatures and equipped with a stirring device, 100 parts of the 9% aqueous solution of polystyrenesulfonic acid were charged, 8.2 parts of aqueous ammonia (10%) (manufactured by Wako Pure Chemical Industries, Ltd.) were added, and the mixture was stirred at 25° C. for 10 minutes. Then, 108 parts of a surfactant comprising a 9% aqueous solution of the polystyrenesulfonic acid ammonium salt (T2) for comparison were obtained (pH=4.1 at 25° C.).

COMPARATIVE EXAMPLE 4

105 parts of a surfactant comprising a 13% aqueous solution of the oleic acid DBU salt (T3) for comparison were obtained in the same manner as in Example 12 except that 100 parts of an 8.7% aqueous solution of oleic acid (manufactured by Tokyo Kasei Kogyo Co., Ltd.) were used instead of 100 parts of a 10% aqueous solution of dodecylbenzenesulfonic acid (pH=10.4 at 25° C.)

COMPARATIVE EXAMPLE 5

105 parts of a surfactant comprising an 11% aqueous solution of the myristic acid DBU salt (T4) for comparison were obtained in the same manner as in Example 12 except that 100 parts of a 7.0% aqueous solution of myristic acid (manufactured by Tokyo Kasei Kogyo Co., Ltd.) were used instead of 100 parts of a 10% aqueous solution of dodecylbenzenesulfonic acid (pH=10.2 at 25° C.).

COMPARATIVE EXAMPLE 6

104 parts of a surfactant comprising a 10% aqueous solution of the myristic acid DBN salt (T5) for comparison were obtained in the same manner as in Example 12 except that 100 parts of a 7.0% aqueous solution of myristic acid were used instead of 100 parts of a 10% aqueous solution of dodecylbenzenesulfonic acid, and 3.8 parts of DBN were used instead of 4.7 parts of DBU (pH=10.0 at 25° C.).

COMPARATIVE EXAMPLE 7

105 parts of a surfactant comprising a 10% aqueous solution of the dodecylbenzenesulfonic acid ammonium (T6) for comparison were obtained in the same manner as in Example 12 except that 5.2 parts of 10% aqueous ammonia were used instead of 4.7 parts of DBU (pH=4.2 at 25° C.).

The surfactants obtained in Examples and Comparative Examples were diluted with ultrapure water (water having the specific resistivity determined using "PURI CMX2" manufactured by Organo Corporation of not less than 18 MΩ) so as to have the concentration of the salts (S1) to (S18) and (T1) to (T6) contained in each surfactant as shown in Table 1 to prepare the detergent of the present invention, and the following evaluations were carried out. The results are shown in Tables 1 and 2. Moreover, the same tests were carried out for ultrapure water alone (Comparative Example 8).

<Zeta Potential>

The zeta potential of particles was determined using an electrophoresis light scattering photometer (ELS-800, manufactured by Otsuka Electronics Co., Ltd.). The transfer rate of particles having the surface charge was determined by an electrophoresis method, and the zeta potential was calculated from the transfer rate by a method of Smoluchowski.

To a 1 L polystyrene container containing 999 mL of ultrapure water, 1 mL of polystyrene latex having the volume average particle diameter of 2.0 μm (manufactured by Duke Scientific Corporation, Catalog No. 4202, 0.5% by weight, CV 1.1%) was added and stirred to obtain a dispersion in which polystyrene latex was diluted in 1,000 times. In a 100 ml beaker, 40 mL of this diluted dispersion of polystyrene latex and 10 mL of the detergent shown in Tables 1 and 2 were uniformly mixed to obtain a mixed solution (50 mL).

Moreover, except that the detergent was changed to ultrapure water, a mixed solution (50 mL) was obtained in the same manner as mentioned above (Comparative Example 8).

Using these mixed solutions, the zeta potential at 25° C. was measured.

<Number of Particles Adhered>

A 4-inch silicon wafer was immersed in 1 L of 0.5% HF aqueous solution in a 1 L beaker at 25° C. for 10 minutes to remove a natural oxidation film. Then, the wafer was immersed in 1 L of ultrapure water in a 1 L beaker at 25° C. for 1 minute to be rinsed.

Next, a mixed solution (1,000 ml) was prepared by mixing 1 mL of polystyrene latex mentioned above with 999 mL of the detergent shown in Tables 1 and 2 in a 1 L beaker.

Moreover, except that the detergent was changed to ultrapure water, a mixed solution (1,000 ml) was obtained in the same manner as mentioned above (Comparative Example 8).

In these mixed solutions, the above-mentioned cleaned silicon wafer was immersed at 25° C. for 10 minutes. Thereafter, the wafer was immersed in 1 L of ultrapure water in a 1 L beaker for 1 minute, taken out, and dried naturally, and then the number of particles adhered on the silicon wafer surface was determined using a laser surface inspection device (WM-2500, manufactured by Topcon Corporation).

<Foamability>

The heights (mm) of foam immediately after foaming and after 5 minutes therefrom were determined for the detergents shown in Tables 1 and 2 at 25° C. according to the Ross & Miles method (Japanese Industrial Standards JIS K 3362: 1998, 8.5 Foamability and Stability of Foam; corresponding to ISO 696).

Moreover, except that the detergent was changed to ultrapure water, determination was carried out in the same manner as mentioned above (Comparative Example 8).

<Surface Tension>

Surface tension (dyn/cm) was determined at 25° C. by the ring method (Japanese Industrial Standards JIS K3362: 1998, 8.4.2 ring method; corresponding to ISO 304) for the detergents shown in Tables 1 and 2.

Moreover, except that the detergent was changed to ultrapure water, determination was carried out in the same manner as mentioned above (Comparative Example 8).

TABLE 1

| | Example | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Salt | S1 | | S2 | S3 | S4 | S5 | S6 | S7 | S8 | S9 | S10 | S11 | | S12 | S13 |
| Q1 (kcal/mol) | 32 | | 32 | 32 | 32 | 32 | 32 | 32 | 32 | 32 | 32 | 32 | | 32 | 32 |
| Q2 (kcal/mol) | 137 | | 147 | 137 | 137 | 137 | 141 | 147 | 139 | 141 | 147 | 137 | | 147 | 109 |
| Concentration of salt (ppm) | 50 | 200 | 50 | 50 | 50 | 50 | 50 | 50 | 50 | 50 | 50 | 50 | 200 | 50 | 50 |
| Zeta potential (mV) | −85 | −105 | −90 | −80 | −90 | −95 | −95 | −95 | −100 | −100 | −90 | −95 | −100 | −95 | −105 |
| Number of particles adhered (number/substrate) | 47 | 25 | 41 | 53 | 38 | 32 | 35 | 29 | 26 | 29 | 45 | 40 | 31 | 45 | 21 |
| Height of foam (mm) | | | | | | | | | | | | | | | |
| Immediately after foaming | 1 | 1 | 1 | 1 | 1 | 1 | 1 | 1 | 1 | 1 | 1 | 150 | 240 | 80 | 120 |
| After 5 minutes | 0 | 0 | 0 | 0 | 0 | 0 | 0 | 0 | 0 | 0 | 0 | 95 | 130 | 50 | 75 |
| Surface tension (dyne/cm) | 65 | 60 | 62 | 65 | 65 | 64 | 62 | 65 | 65 | 62 | 61 | 45 | 35 | 42 | 40 |

TABLE 2

Examples 21 to 31, Comparative Examples 9 to 14

| | Example | | | | | Comparative Example | | | | | | | |
|---|---|---|---|---|---|---|---|---|---|---|---|---|---|
| | 16 | 17 | 18 | 19 | 20 | 1 | 2 | 3 | 4 | 5 | 6 | 7 | 8 |
| Salt | S14 | S15 | S16 | S17 | S18 | T1 | | T2 | T3 | T4 | T5 | T6 | — |
| Q1 (kcal/mol) | 21 | 21 | 21 | 32<br>21 | 46<br>21 | 32 | | 32 | 21 | 21 | 21 | 32 | — |
| Q2 (kcal/mol) | 137 | 137 | 137 | 137 | 137 | 156 | | 156 | 137 | 137 | 141 | 156 | — |
| Concentration of salt (ppm) | 50 | 50 | 50 | 50 | 50 | 50 | 200 | 50 | 50 | 50 | 50 | 50 | — |
| Zeta potential (mV) | −90 | −90 | −90 | −100 | −95 | −48 | −55 | −39 | −40 | −43 | −41 | −50 | 39 |
| Number of particles adhered (number/substrate) | 38 | 54 | 47 | 25 | 28 | 228 | 190 | 292 | 380 | 352 | 365 | 271 | >10000 |
| Height of foam (mm) | | | | | | | | | | | | | |
| Immediately after foaming | 1 | 1 | 1 | 1 | 1 | 2 | 2 | 2 | 180 | 140 | 160 | 310 | 1 |
| After 5 minutes | 0 | 0 | 0 | 0 | 0 | 1 | 1 | 1 | 100 | 75 | 90 | 200 | 0 |
| Surface tension (dyne/cm) | 68 | 68 | 68 | 65 | 63 | 65 | 60 | 68 | 38 | 42 | 40 | 42 | 72 |

In a 1 L beaker, each component shown in Tables 3 and 4 (blending amount described: % by weight) was uniformly stirred and mixed at room temperature (about 20° C.) to prepare the detergents of Examples 21 to 31 and Comparative Examples 9 to 14.

Abbreviations in Tables 3 and 4 are as follows.

C: Tetramethylammonium hydroxide

D-1: Diethyleneglycol monomethylether

D-2: Propyleneglycol

E-1: Glycerin

E-2: Sorbitol

F-1: Ethylene oxide adduct of isodecyl alcohol (addition number of moles 7)

F-2: Ethylene oxide adduct of laurylamine (addition number of moles 7)

G-1: Ethylenediaminetetraacetate

G-2: 1-hydroxyethylidene-1,1-diphosphonic acid

The detergents obtained in Examples 21 to 31 and Comparative Examples 9 to 14 were diluted with ultrapure water in 10 times volume in advance, and the zeta potential, number of particles adhered, and foamability were evaluated. Moreover, as for the evaluation of the surface tension, the detergents before dilution were used. The evaluation results are shown in Tables 3 and 4.

In addition, the contact angle of water which shows the removability of grease on the substrate surfaces after cleaning was determined according to the following method.

<Determination of Contact Angle>

100 ml of the detergent was put in a glass beaker (200 ml), and the beaker was put in an incubation tank at 50° C. for 10 minutes to adjust the temperature. Then, in this detergent, a non-alkali glass substrate for liquid crystal panels ("Corning 1737" manufactured by Corning Incorporated., size 3 cm×3 cm, thickness 0.7 mm) before cleaning was immersed until the whole face of the substrate became immersed, and allowed to stand for 10 minutes. After 10 minutes, the glass substrate was taken out, gently shaken to remove the detergent adhered on the surface, and the substrate was cleaned by shaking for 10 minutes in 500 ml of ultrapure water (in a 1,000 ml beaker) at room temperature (about 20° C.) to be rinsed. After rinse, the substrate taken out was blown by nitrogen to remove moisture adhered on the substrate surface and dried (at room temperature, about 30 seconds). The contact angle of the dried substrate against water after 1 second was determined using a fully automatic contact angle meter (PD-W; manufactured by KYOWA INTERFACE SCIENCE CO., LTD.).

Moreover, except that the detergent was changed to ultrapure water, determination was carried out in the same manner as mentioned above (Comparative Example 8).

The contact angle on the glass substrate surface before cleaning was 75°.

TABLE 3

| | | Example | | | | | | | | | | |
|---|---|---|---|---|---|---|---|---|---|---|---|---|
| | | 21 | 22 | 23 | 24 | 25 | 26 | 27 | 28 | 29 | 30 | 31 |
| Salt | Species | S1 | S3 | S1 | S3 | S11 | S4 | S14 | S17 | S4 | S14 | S17 |
| | Blending amount | 0.2 | 0.2 | 0.2 | 0.2 | 0.2 | 0.2 | 0.2 | 0.2 | 0.2 | 0.2 | 0.2 |
| Alkali component | (C) | 1 | 5 | 5 | 5 | 5 | — | — | — | 0.07 | 0.07 | 0.07 |
| Water-soluble | (D-1) | — | 20 | — | 15 | 10 | — | — | — | — | — | — |
| Organic solvent | (D-2) | — | — | 30 | 15 | 20 | — | — | — | — | — | — |
| Polyhydric | (E-1) | — | — | 5 | — | — | — | — | — | — | — | — |
| alcohol | (E-2) | — | — | — | 2 | 2 | — | — | — | — | — | — |
| Nonionic | (F-1) | — | — | — | — | — | 0.2 | 0.2 | — | 0.2 | — | — |
| surfactant | (F-2) | — | — | — | — | — | — | — | 0.2 | — | 0.2 | 0.2 |
| Chelating agent | (G-1) | — | — | — | — | — | 0.02 | — | — | 0.02 | 0.02 | — |
| | (G-2) | — | — | — | — | — | — | 0.02 | 0.02 | — | — | 0.02 |
| Ultrapure water | | 98.8 | 74.8 | 59.8 | 62.8 | 62.8 | 99.6 | 99.6 | 99.6 | 99.5 | 99.5 | 99.5 |
| Zeta potential (mV) | | −110 | −95 | −90 | −90 | −115 | −110 | −105 | −110 | −120 | −110 | −115 |
| Number of particles adhered (number/substrate) | | 18 | 12 | 14 | 10 | 12 | 10 | 18 | 13 | 8 | 12 | 11 |

TABLE 3-continued

| | Example | | | | | | | | | | |
|---|---|---|---|---|---|---|---|---|---|---|---|
| | 21 | 22 | 23 | 24 | 25 | 26 | 27 | 28 | 29 | 30 | 31 |
| Height of foam (mm) | | | | | | | | | | | |
| Immediately after foaming | 1 | 5 | 7 | 5 | 50 | 80 | 80 | 120 | 85 | 115 | 120 |
| After 5 minutes | 0 | 0 | 0 | 0 | 35 | 60 | 60 | 110 | 65 | 100 | 110 |
| Surface tension (dyne/cm) | 60 | 35 | 52 | 40 | 29 | 28 | 28 | 30 | 28 | 30 | 30 |
| Contact angle after cleaning (°) | 25 | 15 | 20 | 15 | 15 | 15 | 15 | 12 | 10 | 10 | 10 |

TABLE 4

| | | Comparative Example | | | | | | |
|---|---|---|---|---|---|---|---|---|
| | | 8 | 9 | 10 | 11 | 12 | 13 | 14 |
| Salt | Species | — | T1 | T2 | T4 | T6 | — | — |
| | Blending amount | — | 0.2 | 0.2 | 0.2 | 0.2 | — | — |
| Alkali component | (C) | — | 1 | 5 | 5 | 5 | 5 | 5 |
| Water-soluble | (D-1) | — | — | 20 | 15 | 10 | — | 20 |
| Organic solvent | (D-2) | — | — | — | 15 | 20 | — | — |
| Polyhydric | (E-1) | — | — | — | — | — | — | — |
| alcohol | (E-2) | — | — | — | — | — | — | — |
| Ultrapure water | | 100 | 98.8 | 74.8 | 64.8 | 64.8 | 95 | 75 |
| Zeta potential (mV) | | 39 | −70 | −70 | −62 | −58 | −65 | −60 |
| Number of particles adhered (number/subtrate) | | >10000 | 168 | 139 | 182 | 175 | 5800 | 7200 |
| Height of foam (mm) | | | | | | | | |
| Immediately after foaming | | 1 | 1 | 5 | 45 | 60 | 1 | 5 |
| After 5 minutes | | 0 | 0 | 0 | 30 | 50 | 0 | 0 |
| Surface tension (dyne/cm) | | 72 | 62 | 45 | 32 | 30 | 65 | 47 |
| Contact angle after cleaning (°) | | 73 | 60 | 35 | 35 | 40 | 65 | 45 |

From the results in Table 1 to 4, the detergents comprising the surfactant of the present invention were able to lower the zeta potential of particles effectively, and as a result, the number of particles adhered per water could be reduced. From these notices, it was found that the detergent has an effect to prevent readhesion of particles to silicon wafers in the time of cleaning. Moreover, from the results of Examples 1 to 11 in Table 1 and Examples 16 to 20 in table 2, it was found that, the surfactant of the present invention comprising the neutralized salt (AB2) particularly has excellent low-foamability, and also causes no trouble due to foaming, which will become a problem in cleaning. Furthermore, from the results of Table 2, it was found that the detergent of the present invention has an effect of quickly removing oily stain on the substrate surface, since the contact angle of water on the glass substrate surface was decreased in a short time.

INDUSTRIAL APPLICABILITY

The detergent of the present invention is excellent in readhesion prevention effect of stains once removed from an object to be cleaned, thus can be effectively used as a detergent in processes for manufacturing electric components such as semiconductor elements, silicon wafers, color filters, substrates for electron devices (flat panel displays such as liquid crystal panels, plasma and organic EL, light and magnetic disks, CCD), optical lens, printed-circuit boards, cables for optical communications, and LED.

The invention claimed is:

1. A surfactant which comprises a neutralized salt (AB1) and/or a neutralized salt (AB2), the neutralized salt (AB1) comprising:

an acidic compound (A1) containing at least each one of an acid group (X1) of an acid having the difference of heat of formation in an acid dissociation reaction (Q1) of 3 to 200 kcal/mol and a hydrophobic group (Y) containing 1 to 36 carbon atoms; and a nitrogen-containing basic compound (B) having the difference of heat of formation in a proton addition reaction (Q2) of 10 to 152 kcal/mol, wherein (X1) is at least one species selected from the group consisting of a sulfonic acid group, sulfuric acid group, phosphoric acid group, phosphonic acid group, carboxymethyloxy group, carboxyethyloxy group, (di)carboxymethylamino group, (di)carboxyethylamino group, a group represented by the formula (1), and a group represented by the formula (2):

$$—C(H)_a(W)_b—COOH \quad (1)$$

$$—Ar(W)_c—COOH \quad (2)$$

where W represents a nitro group, cyano group, trihalomethyl group, formyl group, acetyl group, alkyloxycarbonyl group, alkylsulfonyl group, ammonio group, or a halogen atom; Ar represents an aryl group containing 5 to 14 carbon atoms; a is an integer of 0 or 1, b is an integer of 1 or 2, and c is an integer of 1 to 8; and the carbon number of an alkyl in the alkyloxycarbonyl group and alkylsulfonyl group is 1 to 3, and the neutralized salt (AB2) comprising:

a polymer (A2) having at least one acid group (X2) within a molecule thereof; and the nitrogen-containing basic compound (B) having a difference of heat of formation in a proton addition reaction (Q2) of 10 to 152 kcal/mol, wherein the nitrogen-containing basic compound (B) is a compound containing at least one of:

N═P—N skeleton within a molecule (B-3) thereof, and a proton sponge derivative (B-4).

2. A surfactant which comprises a neutralized salt (AB1), the neutralized salt (AB1) comprising:

an acidic compound (A1) containing at least each one of an acid group (X1) of an acid having a difference of heat of formation in an acid dissociation reaction (Q1) of 3 to 200 kcal/mol and a hydrophobic group (Y) containing 1 to 36 carbon atoms; and a nitrogen-containing basic compound (B) having a difference of heat of formation in a proton addition reaction (Q2) of 10 to 152 kcal/mol, wherein (X1) is at least one species selected from the group consisting of a sulfonic acid group, sulfuric acid group, phosphoric acid group, phosphonic acid group, carboxymethyloxy group, carboxyethyloxy group, (di)carboxymethylamino group, (di)carboxyethylamino group, a group represented by the formula (1), and a group represented by the formula (2):

$$—C(H)_a(W)_b—COOH \quad (1)$$

$$—Ar(W)_c—COOH \quad (2)$$

where W represents a nitro group, cyano group, trihalomethyl group, formyl group, acetyl group, alkyloxycarbonyl group, alkylsulfonyl group, ammonio group, or a halogen atom; Ar represents an aryl group containing 5 to 14 carbon atoms; a is an integer of 0 or 1, b is an integer of 1 or 2, and c is an integer of 1 to 8; and the carbon number of an alkyl in the alkyloxycarbonyl group and alkylsulfonyl group is 1 to 3, and wherein the acidic compound (A1) is at least one compound selected from the group consisting of sulfonic acid group -containing compounds (A1-1), sulfuric acid group-containing compounds (A1-2), phosphoric acid group-containing compounds (A1-3), phosphonic acid group-containing compounds (A1-4), carboxymethyloxy group-containing compounds (A1-5), carboxyethyloxy group-containing compounds (A1-6), (di)carboxymethylamino group-containing compounds (A1-7), (di)carboxyethylamino group-containing compounds (A1-8), compounds containing the group represented by the formula (1) (A1-9) and compounds containing the group represented by the formula (2) (A1-10), and the nitrogen-containing basic compound (B) is a compound containing at least one amidine skeleton within a molecule (B-2) thereof.

3. A surfactant which comprises a neutralized salt (AB2), the neutralized salt (AB2) comprising:

a polymer (A2) having at least one acid group (X2) within a molecule; and a nitrogen-containing basic compound (B) having a difference of heat of formation in a proton addition reaction (Q2) of 10 to 152 kcal/mol, wherein the polymer (A2) is at least one polymer selected from the group consisting of a sulfuric acid group-containing polymer (A2-2), a phosphoric acid group-containing polymer (A2-3) and a phosphonic acid group-containing polymer (A2-4), and the nitrogen-containing basic compound (B) is a compound containing at least one amidine skeleton within a molecule (B2).

4. A surfactant which comprises a neutralized salt (AB2), the neutralized salt (AB2) comprising:

a polymer (A2) having at least one acid group (X2) within a molecule thereof; and a nitrogen-containing basic compound (B) having a difference of heat of formation in a proton addition reaction (Q2) of 10 to 152 kcal/mol, wherein the polymer (A2) is at least one of a sulfonic acid group-containing polymer (A2-1) and a carboxyl group-containing polymer (A2-5), and the nitrogen-containing basic compound (B) is a compound containing at least one amidine skeleton within a molecule (B2).

5. The surfactant according to claim 1 or 2, wherein the neutralized salt (AB1) satisfies the formula (9);

$$0.01 \leqq \{Q2/(Q1 \times n)\} \leqq 3.0 \quad (9)$$

where n is the number of nitrogen atoms in (B)

6. The surfactant according to claim 1, 3 or 4, wherein the difference of heat of formation in an acid dissociation reaction (Q1) of the acid group (X2) is 3 to 200 kcal/mol.

7. The surfactant according to claim 1, 3 or 4, wherein the neutralized salt (AB2) has a weight average molecular weight of 1,000 to 1,000,000.

8. The surfactant according to claim 1 or 2, wherein the acidic compound (A1) has an HLB value of 5 to 30.

9. The surfactant according to claim 1, which further comprises at least one species selected from the group consisting of a compound containing at least one guanidine skeleton within a molecule (B-1) and a compound containing at least one amidine skeleton within a molecule (B2).

10. The surfactant according to claim 9, wherein the compound containing at least one guanidine skeleton (B-1) is at least one species selected from the group consisting of guanidine, 1, 3, 4, 6, 7, 8 -hexahydro-2-H-pyrimido[1, 2a]pyrimidine, and 1, 3, 4, 6, 7, 8 -hexahydro-1-methyl-2H-pyrimido [1,2a]pyrimidine.

11. The surfactant according to claim 2, 3 or 4, which further comprises at least one species selected from the group consisting of a compound containing at least one guanidine skeleton within a molecule (B-1), a compound containing at least one N═P—N skeleton within a molecule (B-3) and a proton sponge derivative (B-4).

12. The surfactant according to claim 11, wherein the compound containing at least one guanidine skeleton (B-1) is at least one species selected from the group consisting of guanidine, 1, 3, 4, 6, 7, 8 -hexahydro-2H-pyrimido [1,2-a]pyrimidine, and 1, 3, 4, 6, 7, 8 -hexahydro-1-methyl-2 H-pyrimido [1,2-a]pyrimidine.

13. The surfactant according to claim 2, 3 or 4, wherein the compound containing at least one amidine skeleton (B-2) is 1,8-diazabicyclo[5.4.0]undecene -7 and/or 1,5-diazabicyclo [4.3.0]nonene-5.

14. The surfactant according to claim 1, wherein the compound containing at least one N═P—N skeleton (B-3) is a phosphazene compound.

15. The surfactant according to claim 1, 3 or 4, wherein the nitrogen-containing basic compound (B) has a molecular volume ($nm^3$) of 0.025 to 0.7.

16. The surfactant according to claim 1, 3 or 4, wherein the acid group (X2) is at least one species selected from the group consisting of a sulfonic acid group, sulfuric acid group, phosphoric acid group, phosphonic acid group, and carboxyl group.

17. A detergent which comprises a surfactant according to claim 1.

18. The detergent according to claim 17, additionally comprising an alkali component (C).

19. The detergent according to claim 18, wherein the alkali component (C) is an organic alkali (C1) represented by formula (17):

(17)

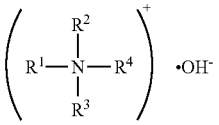

where $R^1$, $R^2$, $R^3$ and $R^4$ each represents a hydrocarbon group containing 1 to 24 carbon atoms, or the group represented by $—(R^5O)_p—H$; $R^5$ represents an alkylene group containing 2 to 4 carbon atoms; and p represents an integer of 1 to 6.

20. The detergent according to claim 17, additionally comprising at least one of a water-soluble organic solvent (D) and water.

21. The detergent according to claim 17, additionally comprising a polyhydric alcohol (E) having 3 to 2,000 valences.

22. The detergent according to claim 17, additionally comprising at least one of a nonionic surfactant and a additional anionic surfactant.

* * * * *

UNITED STATES PATENT AND TRADEMARK OFFICE

CERTIFICATE OF CORRECTION

PATENT NO. : 7,704,939 B2
APPLICATION NO. : 11/626885
DATED : April 27, 2010
INVENTOR(S) : Kazumitsu Suzuki et al.

It is certified that error appears in the above-identified patent and that said Letters Patent is hereby corrected as shown below:

Claim 10, Column 48, lines 38-40:

"1,3,4,6,7,8-hexahydro-2H-pyrimido[1,2a]pyrimidine, and
1,3,4,6,7,8-hexahydro-1-methyl-2H- pyrimido[1,2a]pyrimidine" should read
--1,3,4,6,7,8-hexahydro-2H-pyrimido[1,2-a]pyrimidine, and
1,3,4,6,7,8-hexahydro-1-methyl-2H-pyrimido[1,2-a]pyrimidine--

Claim 15, Column 48, line 60: "claim 1, 3 or 4" should read --claim 1, 2, 3 or 4--

Signed and Sealed this

Seventeenth Day of August, 2010

David J. Kappos

David J. Kappos
*Director of the United States Patent and Trademark Office*